US010199745B2

(12) United States Patent
Lavin et al.

(10) Patent No.: US 10,199,745 B2
(45) Date of Patent: Feb. 5, 2019

(54) OMNIDIRECTIONAL ANTENNA SYSTEM

(71) Applicant: The Boeing Company, Chicago, IL (US)

(72) Inventors: Ronald O. Lavin, Gilbert, AZ (US); Andy H. Lee, Phoenix, AZ (US); Glenn T. Pyle, Mesa, AZ (US); Mark E. Robeson, Yorktown, VA (US)

(73) Assignee: The Boeing Company, Chicago, IL (US)

( * ) Notice: Subject to any disclaimer, the term of this patent is extended or adjusted under 35 U.S.C. 154(b) by 349 days.

(21) Appl. No.: 14/731,062

(22) Filed: Jun. 4, 2015

(65) Prior Publication Data

US 2017/0302006 A1 Oct. 19, 2017

(51) Int. Cl.

| | |
|---|---|
| ***H01Q 1/28*** | (2006.01) |
| ***H01Q 21/20*** | (2006.01) |
| ***H01Q 25/00*** | (2006.01) |
| ***H01Q 1/38*** | (2006.01) |
| ***H01Q 3/30*** | (2006.01) |
| *H01Q 9/04* | (2006.01) |

(52) U.S. Cl.

CPC ..... *H01Q 21/205* (2013.01); *H01Q 1/287* (2013.01); *H01Q 1/38* (2013.01); *H01Q 3/30* (2013.01); *H01Q 25/005* (2013.01); *H01Q 9/0414* (2013.01)

(58) Field of Classification Search

CPC ..... H01Q 25/005; H01Q 1/22; H01Q 1/2258–1/2275; H01Q 1/2291; H01Q 1/24–1/246; H01Q 1/27; H01Q 1/28–1/283; H01Q 1/286; H01Q 1/287; H01Q 1/38; H01Q 1/44; H01Q 3/30; H01Q 9/0414

See application file for complete search history.

(56) References Cited

U.S. PATENT DOCUMENTS

| | | | | |
|---|---|---|---|---|
| 2,990,547 A | | 6/1961 | McDougal | |
| 3,453,628 A | * | 7/1969 | Dolan | H01Q 1/283 343/708 |
| 3,810,183 A | | 5/1974 | Krutsinger et al. | |
| 3,823,404 A | | 7/1974 | Buie, Jr. | |
| 3,972,045 A | | 7/1976 | Perret | |
| 4,072,952 A | * | 2/1978 | Demko | H01Q 1/283 343/700 MS |
| 4,392,139 A | | 7/1983 | Aoyama et al. | |

(Continued)

FOREIGN PATENT DOCUMENTS

| | | |
|---|---|---|
| CN | 101673880 B | 3/2010 |
| EP | 2065976 A1 | 6/2009 |

(Continued)

OTHER PUBLICATIONS

European Patent Office, Extended European Search Report, EP 16 17 3074 (dated Oct. 11, 2016).

(Continued)

*Primary Examiner* — Tho G Phan
*Assistant Examiner* — Patrick Holecek
(74) *Attorney, Agent, or Firm* — Walters & Wasylyna LLC

(57) ABSTRACT

An antenna system may include a first antenna, and a second antenna opposite the first antenna, wherein the first antenna and the second antenna are configured to provide omnidirectional coverage.

20 Claims, 14 Drawing Sheets

(56) References Cited

U.S. PATENT DOCUMENTS

| | | | | |
|---|---|---|---|---|
| 4,816,836 | A | 3/1989 | Lalezari | |
| 4,843,403 | A | 6/1989 | Lalezari et al. | |
| 5,315,309 | A | 5/1994 | Rudow et al. | |
| 5,333,002 | A | 7/1994 | Gans et al. | |
| 5,437,091 | A | 8/1995 | Norman | |
| 5,583,507 | A | 12/1996 | D'Isepo et al. | |
| 5,646,633 | A | 7/1997 | Dahlberg | |
| 5,872,546 | A | 2/1999 | Ihara et al. | |
| 5,898,405 | A | 4/1999 | Iwasaki | |
| 6,121,936 | A | 9/2000 | Hemming et al. | |
| 6,198,445 | B1 | 3/2001 | Alt et al. | |
| 6,914,563 | B2 | 7/2005 | Chen et al. | |
| 7,030,820 | B2 | 4/2006 | Stiller | |
| 7,113,852 | B2 | 9/2006 | Kapadia et al. | |
| 7,233,295 | B2 | 6/2007 | Regala | |
| 7,395,084 | B2 * | 7/2008 | Anttila | H01Q 1/28 342/417 |
| 7,633,451 | B2 | 12/2009 | Robin et al. | |
| 8,395,557 | B2 | 3/2013 | Goins et al. | |
| 8,514,136 | B2 | 8/2013 | McCarthy et al. | |
| 8,791,868 | B2 | 7/2014 | McCarthy et al. | |
| 2004/0070536 | A1 | 4/2004 | Stotler et al. | |
| 2007/0194999 | A1 | 8/2007 | Morton | |
| 2008/0316124 | A1 | 12/2008 | Hook | |
| 2015/0109177 | A1 | 4/2015 | Lavin | |
| 2017/0084988 | A1 | 3/2017 | Lavin et al. | |
| 2017/0301980 | A1 | 10/2017 | Lavin et al. | |

FOREIGN PATENT DOCUMENTS

| | | | | |
|---|---|---|---|---|
| EP | 2184804 | A1 | 5/2010 | |
| EP | 2782190 | A1 | 9/2014 | |
| GB | 647425 | A * | 12/1950 | H01Q 1/287 |

OTHER PUBLICATIONS

Narbudowicz et al., "Dual-Band Omnidirectional Circularly Polarized Antenna," *IEEE Transactions on Antennas and Propagation*, vol. 61, No. 1 (2013).

Falade et al., "Stacked-Patch Dual-Polarized Antenna for Triple-Band Handheld Terminals," *IEEE Antennas and Wireless Propagation Letters*, vol. 12 (2013).

Serra et al., "A wideband dual-polarized stacked patch antenna for base stations," *Antennas and Propagation Society International Symposium 2006*, IEEE Albuquerque, NM, Jul. 2006.

European Patent Office, Communication pursuant to Article 94(3) EPC, EP 16 173 074.2 (dated Nov. 17, 2017).

* cited by examiner

OMNIDIRECTIONAL ANTENNA SYSTEM

GOVERNMENT RIGHTS

This invention was made with government support under Technology Investment Agreement No. W911W6-11-2-0 awarded by the Department of Defense. The government has certain rights in this invention.

FIELD

The present disclosure is generally related to antennas and, more particularly, to a phased omnidirectional antenna system, for example, for aerospace vehicles.

BACKGROUND

Most modern vehicles utilize antenna systems to transmit and/or receive radio communications. Typically, antennas are installed on (e.g., fastened to) an exterior of the vehicle. In order to provide desired communications coverage, the antenna may be subject to particular size and location constraints.

In aerospace vehicles, the particular type of antenna and/or the antenna location must account for various factors such as environmental exposure (e.g., airflow, ice accretion, lightning strike susceptibility, etc.), structural and coverage requirements (e.g., airframe shadowing, ground clearance, antenna crowding, etc.) and/or aerodynamic effects (e.g., weight, wind drag, etc.) One approach to exterior mounted antennas is covering the antenna with a radome mounted to the exterior of the vehicle. While a radome may reduce some of the aerodynamic effects and/or environmental exposure of the antenna, utilization of a radome increases the complexity, weight and cost of the antenna system.

In view of such factors, finding an appropriate location to mount the antenna on the outside of the aerospace vehicle may be difficult. As one particular example, and in the case of a helicopter, finding an appropriate location on the outside of a helicopter body to mount the antenna, where the antenna will not interfere with a rotor, a stabilizer, or control surfaces of the helicopter, may be more difficult. Certain structures of the aerospace vehicle may provide a more attractive location for embedding conformal antennas, particularly for longer wavelengths such as high frequency ("HF"), very high frequency ("VHF") and/or ultra high frequency ("UHF"), than other structures.

Accordingly, those skilled in the art continue with research and development efforts in the field of antenna systems for aerospace vehicles.

SUMMARY

In one embodiment, the disclosed antenna system may include a first antenna, and a second antenna opposite the first antenna, wherein the first antenna and the second antenna are configured to provide omnidirectional coverage.

In another embodiment, the disclosed antenna system may include a structure including a first end and a second end opposite the first end, a first antenna coupled to the first end of the structure, and a second antenna coupled to the second end of the structure, wherein the first antenna and the second antenna are configured to provide omnidirectional coverage.

In yet another embodiment, the disclosed method for providing omnidirectional coverage of an antenna system may include the steps of: (1) providing a first antenna, the first antenna including a first radiation pattern, the first radiation pattern including a first null, (2) providing a second antenna opposite the first antenna, the second antenna comprising a second radiation pattern, the second radiation pattern comprising a second null, (3) filling the first null with the second radiation pattern, and (4) filling the second null with the second radiation pattern.

Other embodiments of the disclosed systems and method will become apparent from the following detailed description, the accompanying drawings and the appended claims.

DETAILED DESCRIPTION

Figure 1:
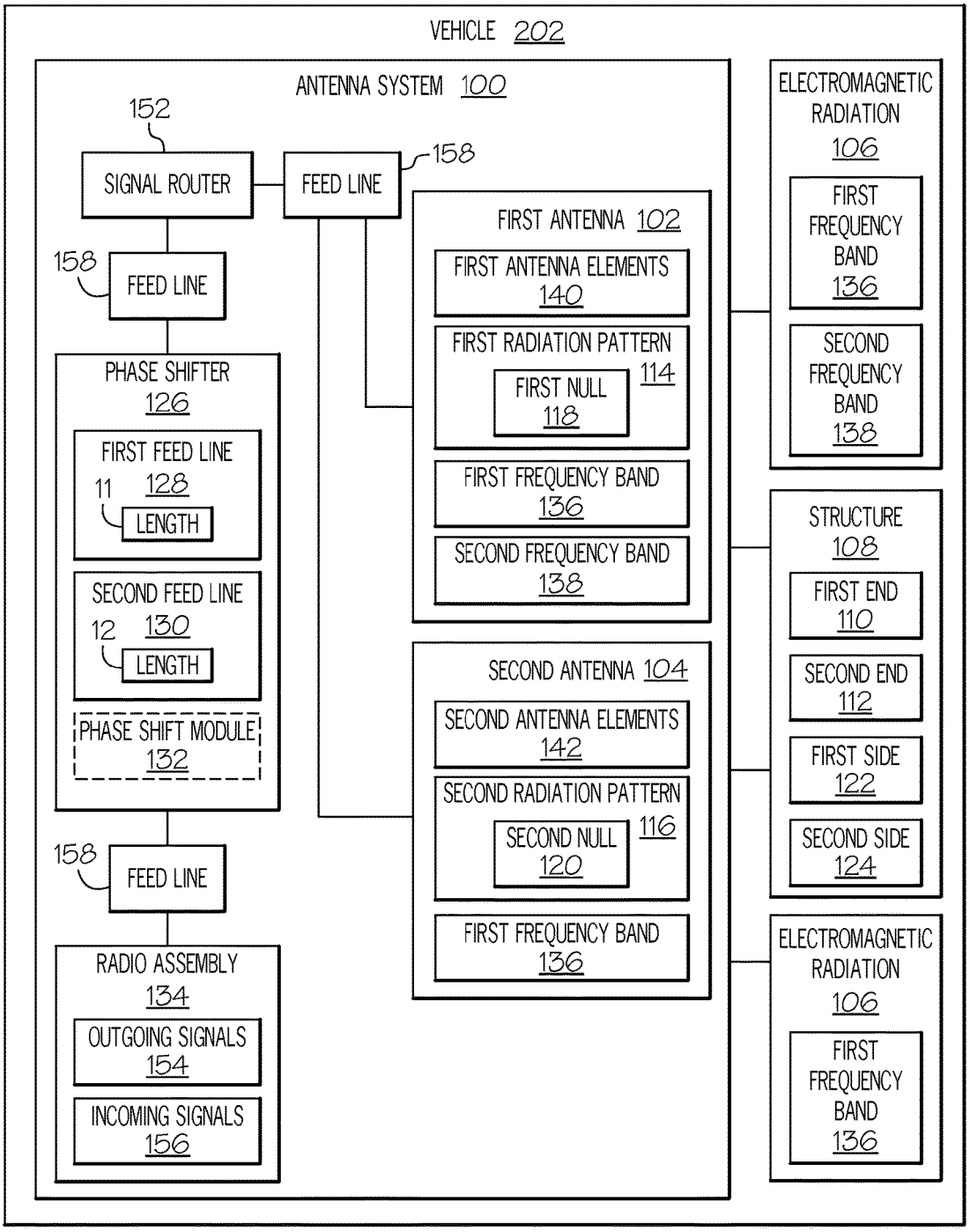
FIG. 1 is a schematic block diagram of one embodiment of the disclosed antenna system.

The following detailed description refers to the accompanying drawings, which illustrate specific embodiments of the disclosure. Other embodiments having different structures and operations do not depart from the scope of the present disclosure. Like reference numerals may refer to the same element or component in the different drawings.

Figure 7:
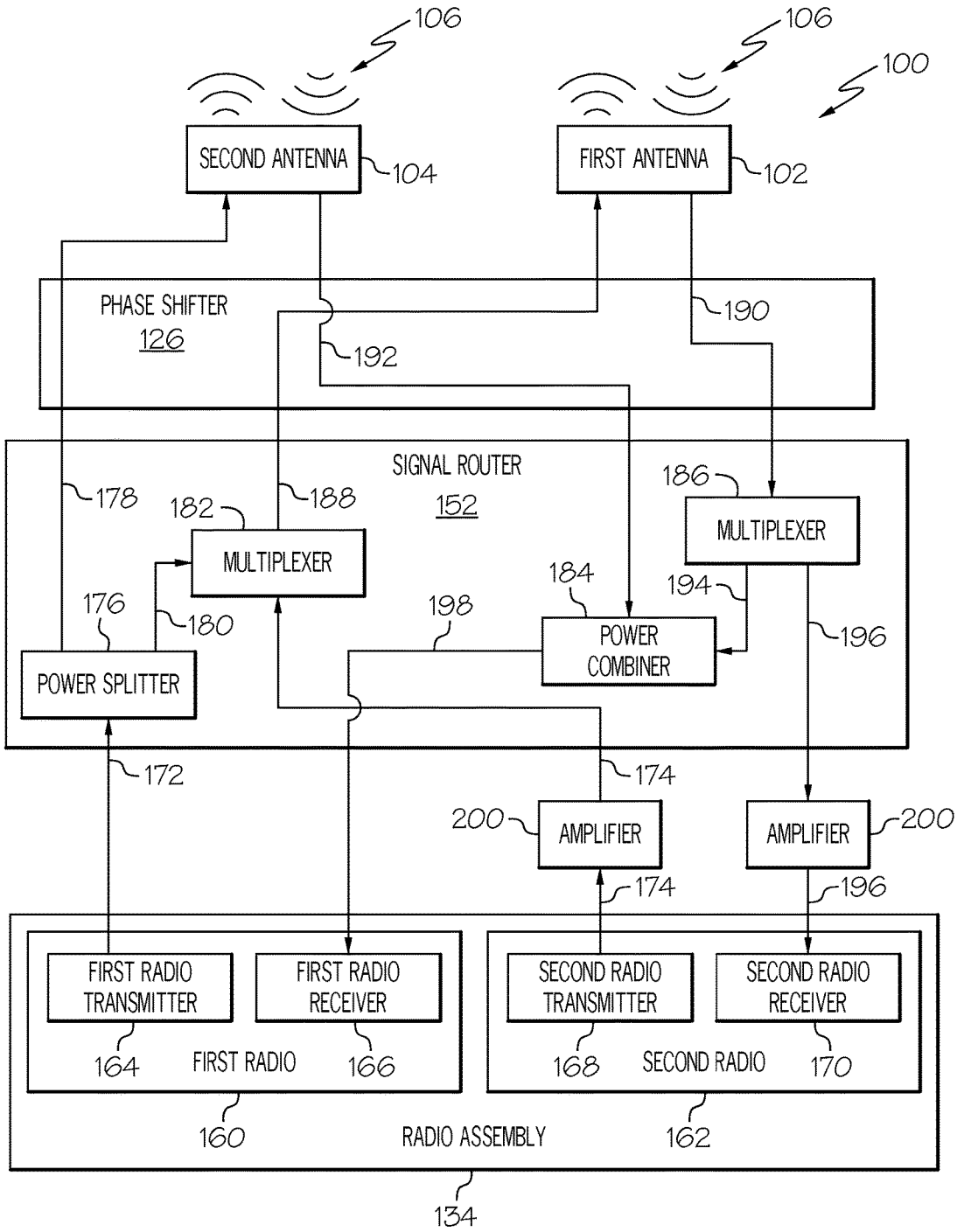
FIG. 7 is a schematic block diagram of one embodiment of the antenna system.
Figure 19:
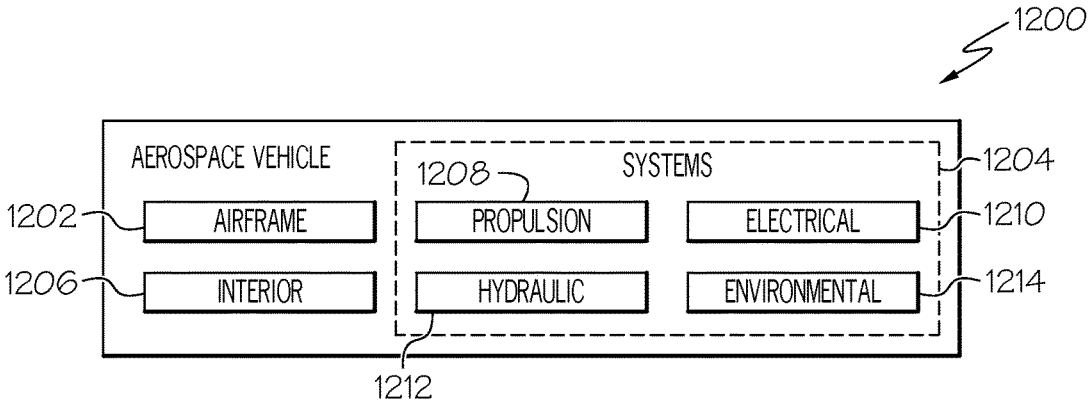
FIG. 19 is a schematic illustration of an aerospace vehicle.

In FIGS. 1, 7 and 19 referred to above, solid lines, if any, connecting various elements and/or components may represent mechanical, electrical, fluid, optical, electromagnetic and other couplings and/or combinations thereof. As used herein, "coupled" means associated directly as well as indirectly. For example, a member A may be directly associated with a member B, or may be indirectly associated therewith, e.g., via another member C. It will be understood that not all relationships among the various disclosed elements are necessarily represented. Accordingly, couplings other than those depicted in the block diagrams may also exist. Dashed lines, if any, connecting blocks designating the various elements and/or components represent couplings similar in function and purpose to those represented by solid lines; however, couplings represented by the dashed lines may either be selectively provided or may relate to alternative examples of the present disclosure. Likewise, elements and/or components, if any, represented with dashed lines, indicate alternative examples of the present disclosure. One or more elements shown in solid and/or dashed lines may be omitted from a particular example without departing from the scope of the present disclosure. Those skilled in the art will appreciate that some of the features illustrated in FIGS. 1, 7 and 19 may be combined in various ways without the need to include other features described in FIGS. 1, 7 and 19, other drawing figures, and/or the accompanying disclosure, even though such combination or combinations are not explicitly illustrated herein. Similarly, additional features not limited to the examples presented, may be combined with some or all of the features shown and described herein.

Figure 17:
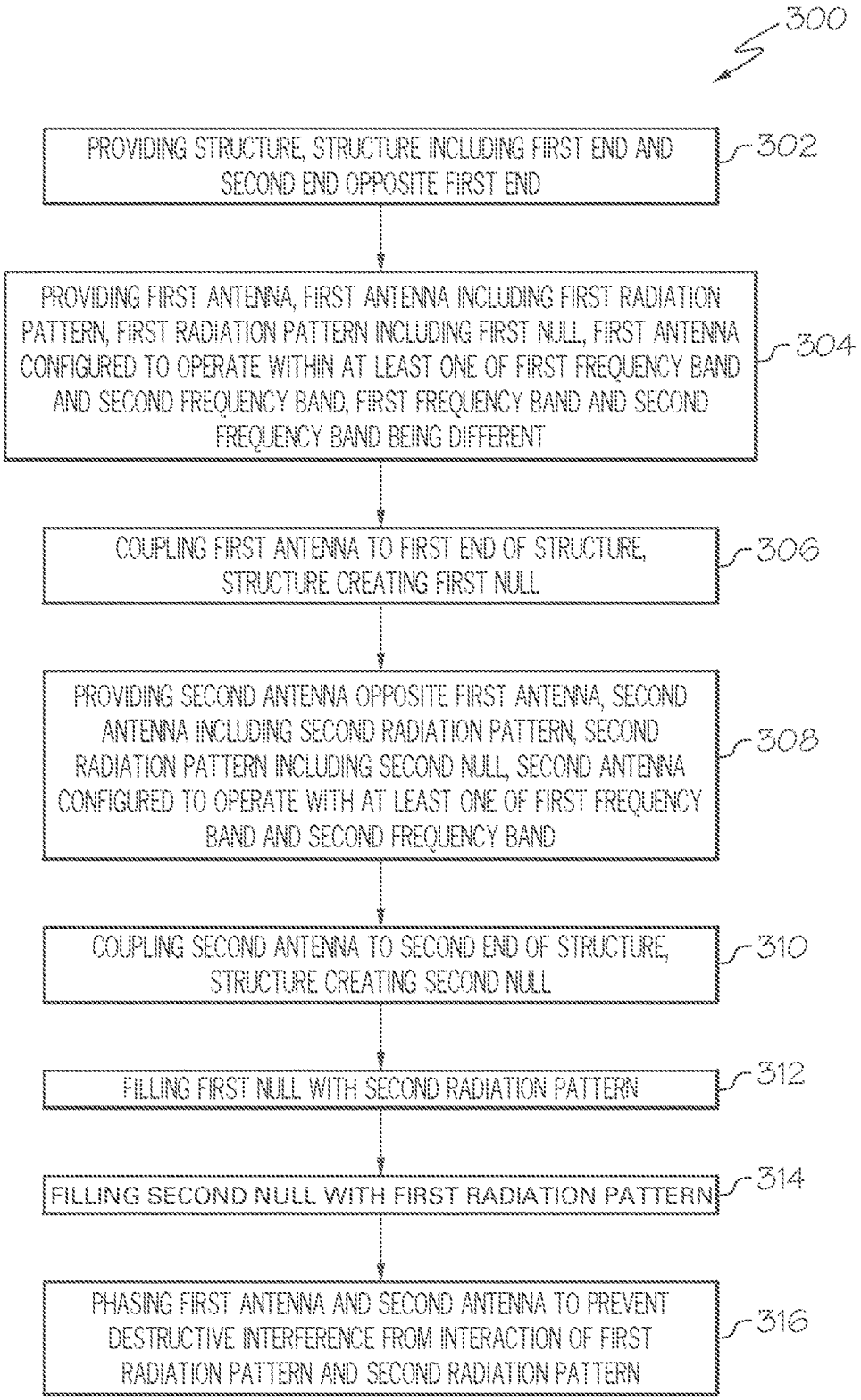
FIG. 17 is a flow diagram of one embodiment of the disclosed method for providing omnidirectional coverage of the antenna system of FIG. 1.
Figure 18:
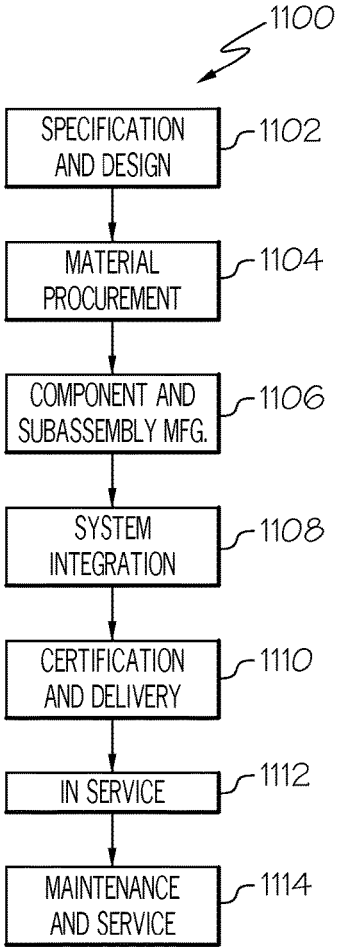
FIG. 18 is a block diagram of an aerospace vehicle production and service methodology.

In FIGS. 17 and 18, referred to above, the blocks may represent operations and/or portions thereof and lines connecting the various blocks do not imply any particular order or dependency of the operations or portions thereof. Blocks represented by dashed lines indicate alternative operations and/or portions thereof. Dashed lines, if any, connecting the various blocks represent alternative dependencies of the operations or portions thereof. It will be understood that not all dependencies among the various disclosed operations are necessarily represented. FIGS. 17 and 18 and the accompanying disclosure describing the operations of the method(s) set forth herein should not be interpreted as necessarily determining a sequence in which the operations are to be performed. Rather, although one illustrative order is indicated, it is to be understood that the sequence of the operations may be modified when appropriate. Accordingly, certain operations may be performed in a different order or simultaneously. Additionally, those skilled in the art will appreciate that not all operations described need be performed.

Reference herein to "example" means that one or more feature, structure, or characteristic described in connection with the example is included in at least one embodiment or implementation. The phrase "one example" or "another example" in various places in the specification may or may not be referring to the same example.

Figure 2:
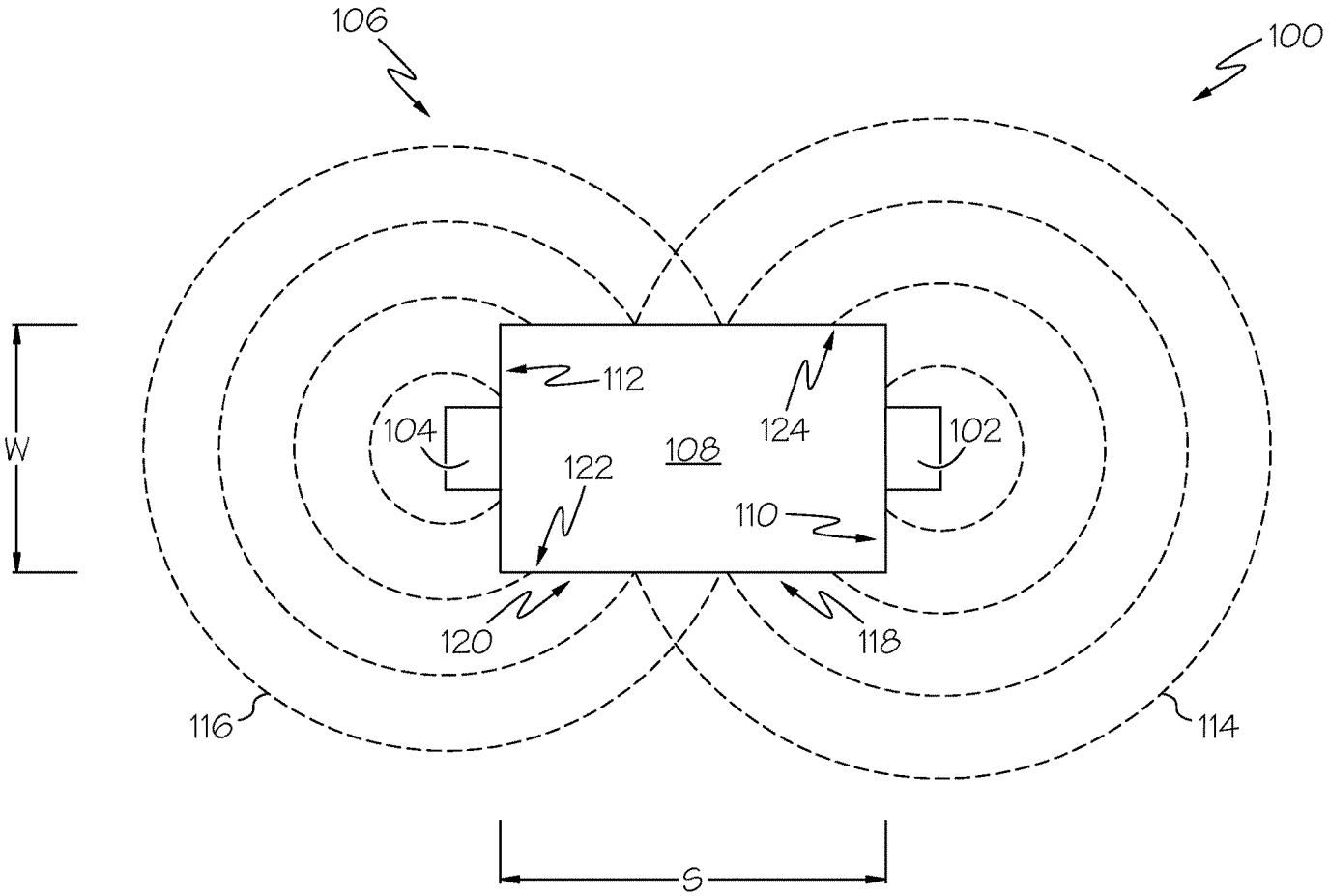
FIG. 2 is a schematic plan view of one embodiment of the antenna system of FIG. 1.

Referring to FIGS. 1 and 2, one embodiment of antenna system, generally designated 100, is disclosed. Antenna system 100 may be configured to provide omnidirectional coverage. Antenna system 100 may include first antenna 102 and second antenna 104 opposite first antenna 102. First antenna 102 and second antenna 104 may be aligned. First antenna 102 and second antenna 104 may be configured to provide omnidirectional coverage of electromagnetic radiation 106 (e.g., radio waves). First antenna 102 and second antenna 104 may be any suitable type of antenna (e.g., a single element antenna structure or a multiple element antenna assembly) configured to transmit and/or receive electromagnetic radiation 106 (e.g., radio waves).

Unless otherwise indicated, the terms "first," "second," "third," "fourth," etc. are used herein merely as labels, and are not intended to impose ordinal, positional, or hierarchical requirements on the items to which these terms refer. Moreover, reference to a "second" item does not require or preclude the existence of lower-numbered item (e.g., a "first" item) and/or a higher-numbered item (e.g., a "third" item).

As one example, first antenna 102 and/or second antenna 104 may be configured to provide single band radiation (e.g., one frequency band). As one general, non-limiting example, first antenna 102 and/or second antenna 104 may be a single element antenna. As one non-limiting example, first antenna 102 and/or second antenna 104 may be a dipole antenna. As another non-limiting example, first antenna 102 and/or second antenna 104 may be a monopole antenna. As another non-limiting example, first antenna 102 and/or second antenna 104 may be a slot antenna. As yet another non-limiting example, first antenna 102 and/or second antenna 104 may be a cavity-backed antenna (e.g., cavity-backed slot antenna, cavity-backed spiral antenna, cavity-backed flat antenna, etc.)

As another example, and as will be described in greater detail herein, first antenna 102 and/or second antenna 104 may be configured to provide multiple band radiation (e.g., two or more frequency bands). As one general, non-limiting example, first antenna 102 and/or second antenna 104 may be a multi-element antenna. As one non-limiting example, first antenna 102 and/or second antenna 104 may be a stacked array of stake monopole (e.g., flat) antennas. As another non-limiting example, first antenna 102 and/or second antenna 104 may be a sleeve monopole antenna. As another non-limiting example, first antenna 102 and/or second antenna 104 may be a spiral antenna. As another non-limiting example, first antenna 102 and/or second antenna 104 may a dipole array of antennas (e.g., flat antennas). As yet another non-limiting example, first antenna 102 and/or second antenna 104 may a multi-arm spiral antenna.

As one example, first antenna 102 and second antenna 104 may have a vertical orientation, for example, to provide vertical polarization of radio waves (e.g., for radio transmission and/or reception). As another example, first antenna 102 and second antenna 104 may have a horizontal orientation, for example, to provide horizontal polarization of radio waves (e.g., for television transmission and/or reception). As yet another example, first antenna 102 and second antenna 104 may have a vertical and a horizontal orientation, for example, to provide circular polarization of radio waves. Other orientations of first antenna 102 and second antenna 104 are also contemplated, and those skilled in the art will recognize that the particular orientation of first antenna 102 and second antenna 104 may be application specific.

Referring to FIG. 2, and with reference to FIG. 1, first antenna 102 may include (e.g., be configured to provide) first radiation pattern 114. Second antenna 104 may include (e.g., be configured to provide) second radiation pattern 116. First radiation pattern 114 may include first null 118 (e.g., first null 118 may be located within first radiation pattern 114). Second radiation pattern 116 may include second null 120 (e.g., second null 120 may be located within second radiation pattern 116). First radiation pattern 114 and second radiation pattern 116 may complement each other to provide an omnidirectional radiation pattern. As one example, during operation of first antenna 102 and second antenna 104, first radiation pattern 114 may fill second null 120 and second radiation pattern 116 may fill first null 118 to provide the omnidirectional radiation pattern. Thus, as one example, the omnidirectional radiation pattern may be a composite pattern including the sum of first radiation pattern 114 and second radiation pattern 116.

Referring to FIG. 2, and with reference to FIG. 1, first antenna 102 and second antenna 104 may be disposed on structure 108. As one example, first antenna 102 and second antenna 104 may be coupled to structure 108. As another example, first antenna 102 and second antenna 104 may be embedded within, e.g., a portion of, structure 108. As another example, first antenna 102 and/or second antenna 104 may be a conformal antenna. As one example, first antenna 102 and/or second antenna 104 may be configured to conform or follow some prescribed shape, for example, the shape of a portion of structure 108.

Structure 108 may separate first antenna 102 and second antenna 104. As one example, structure 108 may include first end 110, second end 112 opposite first end 110, first side 122 extending between first end 110 and second end 112, and second side 124 extending between first end 110 and second end 112 opposite first side 122. First antenna 102 may be disposed at first end 110 of structure 108. Second antenna 104 may be disposed at second end 112 of structure 108. A linear dimension between first end 110 and second end 112 may define a separation distance S between first antenna 102 and second antenna 104.

Figure 3:
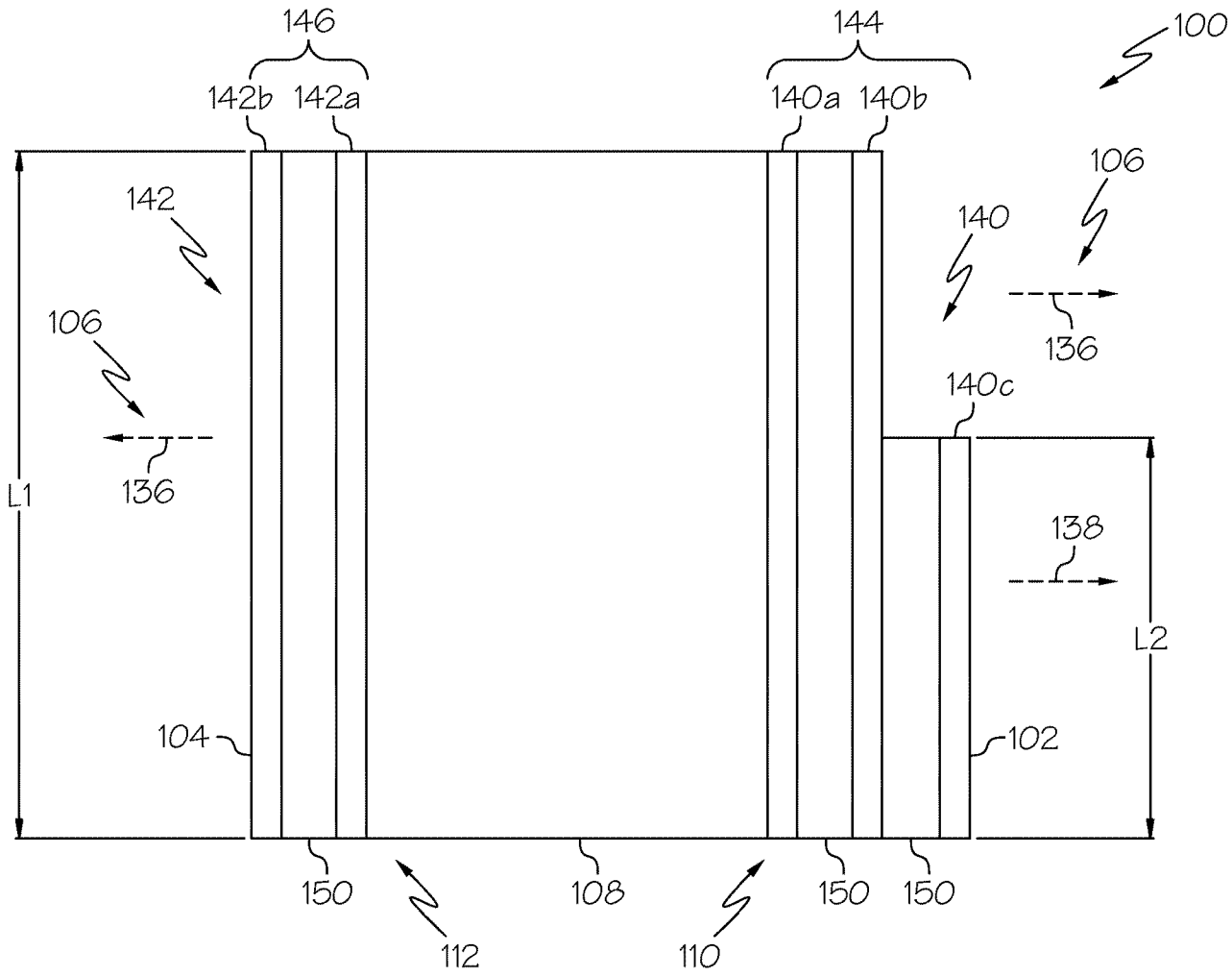
FIG. 3 is a schematic side elevational view of one embodiment of the antenna system of FIG. 1.

Referring to FIG. 3, and with reference to FIG. 2, structure 108, or a portion thereof, may act as a radome to cover and/or protect first antenna 102 (e.g., first antenna elements 140) and/or second antenna 104 (e.g., second antenna elements 142).

First null 118 in first radiation pattern 114 and second null 120 in second radiation pattern 116 may be created by structure 108. As one example, a shadowing of structure 108, for example, created by structure 108 being between first antenna 102 and second antenna 104, may create first null 118 and second null 120. The amount of shadowing created by structure 108 (e.g., the size of first null 118 and second null 120) may depend on, for example, width W of structure 108 (e.g., the linear dimension between first side 122 and second side 124 of structure 108) and/or the wavelength of operation of first antenna 102 and/or second antenna 104. During operation of first antenna 102 and second antenna 104, first radiation pattern 114 may radiate within the shadow created by structure 108 (e.g., to fill second null 120) and second radiation pattern 116 may radiate within the shadow created by structure 108 (e.g., to fill first null 118) to provide the omnidirectional radiation pattern and, thus, accounting for the shadowing of structure 108.

First radiation pattern 114 of first antenna 102 and second radiation pattern 116 of second antenna 104 may have areas of overlap. As one example, and without being limited to any particular theory, in the area of overlap (e.g., where there is a phase difference of approximately 180-degrees), the radiation patterns may cancel in a phenomenon known as far-field pattern destructive interference. To reduce this effect, the radiation patterns may be phased to move the areas where they cancel to ranges of angles that are less likely to cancel and/or have impact on the transmission of the radio waves. Generally, these areas are where the first radiation pattern 114 of first antenna 102 and second radiation pattern 116 of second antenna 104 are of significantly unequal magnitude, such that adding them where there phases oppose does not result in cancellation.

To account for potential destructive interference, first antenna 102 and second antenna 104 may be phased to prevent out of phase overlap of first radiation pattern 114 and second radiation pattern 116, for example, in areas not shadowed (e.g. blocked) by structure 108. Phasing first antenna 102 and second antenna 104 may prevent secondary (e.g., interference) nulls (not illustrated) from forming, for example, outward of first side 122 and second side 124 of structure 108. As one example, first antenna 102 and second antenna 104 may be phased to prevent destructive interference from interaction of first radiation pattern 114 and second radiation pattern 116. As one example, first antenna 102 and second antenna 104 may be phased to steer destructive far-field interference of first radiation pattern 114 and second radiation pattern 116 (e.g., caused by the overlap of first radiation pattern 114 and second radiation pattern 116 adding together out of phase) to one of first null 118 and/or second null 120.

Those skilled in the art will recognize that the amount of destructive interference may be at least partially dictated by, for example, width W (e.g., the thickness) of structure 108. As one example, as width W of structure 108 increases (e.g., as the linear distance between first side 122 and second side 124 increases), the areas of overlap of first radiation pattern 114 and second radiation pattern 116 may decrease.

The destructive interference from interaction of first radiation pattern 114 and second radiation pattern 116 present and the amount of phasing required to appropriately reduce the destructive interference may vary depending on, for example, the particular application, the size and shape of structure 108 (e.g., width W of structure 108), the wavelength of operation, the type of antenna (e.g., the element type, physical dimensions and/or layout), the shape of first radiation pattern 114, the shape of second radiation pattern 116 and/or the separation distance S between first antenna 102 and second antenna 104.

As non-limiting examples, the amount of phase difference (e.g., time delay) between first radiation pattern 114 and second radiation pattern 116 needed to appropriately reduce the destructive interference may be determined analytically, empirically from measurement or parametrically from simulation.

Referring generally to FIG. 1, antenna system 100 may include phase shifter 126. Phase shifter 126 may be coupled to first antenna 102 and second antenna 104, for example, between first antenna 102 and second antenna 104 and radio assembly 134. Phase shifter 126 may be configured to set effective radiation patterns of first antenna 102 and second antenna 104 in a desired direction and/or introduce a time delay between first radiation pattern 114 and second radiation pattern 116.

Those skilled in the art will recognize that different types of phase shifters 126 may be utilized and/or various techniques may be utilized to phase first antenna 102 (e.g., first radiation pattern 114) and second antenna 104 (e.g., second radiation pattern 116) depending upon, for example, the configuration of antenna system 100, the configuration (e.g., the size and/or shape) of structure 108 and the like.

Referring to FIG. 1, as one example, phase shifter 126 may include first feed line 128 and second feed line 130. First feed line 128 may be coupled between first antenna 102 and radio assembly 134. Second feed line 130 may be coupled between second antenna 104 and radio assembly 134. First feed line 128 and/or second feed line 130 may include any suitable conductor capable of transmitting radio frequency ("RF") signals from a transmitter to an antenna. As one non-limiting example, first feed line 128 and/or second feed line 130 may include coaxial cable having a connector (e.g., a Threaded Neill-Concelmen ("TNC") connector) configured to be coupled to first antenna 102 and second antenna 104, respectively.

As one example, appropriate phase shifting may be achieved by including different lengths of first feed line 128 and second feed line 130. As one example, first feed line 128 may include first length l1 and second feed line 130 may include second length l2. First length l1 of first feed line 128 and second length l2 of second feed line 130 may be different. As one example, first length l1 of first feed line 128 may be greater than (e.g., longer than) second length l2 of second feed line 130. As another example, second length l2 of second feed line 130 may be greater than (e.g., longer than) first length l1 of first feed line 128.

Without being limited to any particular theory, it is currently believed that the particular lengths of different feed lines is one factor in achieving a phase shift (e.g., a time delay) between radiation patterns of two antennas radiating radio waves transmitted from the same radio transmitter. Therefore, by differing first length l1 of first feed line 128 and second length l2 of second feed line 130, an appropriate amount of phase difference may be achieved to reduce destructive interference, for example, for a limited range of frequencies determined by the wavelength of operation and the difference of first length l1 and second length l2.

The relationship between the lengths of the feed lines (e.g., first length l1 of first feed line 128 and second length l2 of second feed line 130) and the phasing may generally be defined by the following equation:

$$D=R\times T \quad \text{(Eq. 1)}$$

wherein D is a distance between a radio transmitter and an antenna defined by the length of the feed line, R is a rate of a radio frequency ("RF") signal defined by the velocity of the RF signal through the feed line, and T is a time defining the time delay desired to achieve the appropriate (or desired) phasing.

Therefore, upon a desired phase shift (e.g., time delay) being determined, the length of each of first feed line 128 and second feed line 130 may be determined. Thus, the difference between first length l1 of first feed line 128 and second length l2 of second feed line 130 may be based on a predetermined (e.g., desired) phase relationship between first antenna 102 and second antenna 104.

Those skilled in the art will recognize that R may be dictated by various factors including, but not limited to, the type of conductor used as the feed line and/or the velocity factor (e.g., a known constant that is a fraction of the speed of light in a vacuum) of the particular feed line used.

Those skilled in the art will also recognize that factors other than those described herein may be used to establish the relationship between the lengths of the feed lines and the phasing of two antennas in order to determine the appropriate phase shift between radiation patterns of two antennas radiating radio waves transmitted from the same radio transmitter.

Utilizing differing lengths of the feed lines (e.g., first feed line 128 having first length l1 and second feed line 130 having second feed line 12 different that first length l1) to achieve the appropriate or desired phasing of first antenna 102 and second antenna 104 may be beneficial and/or advantageous compared to other phasing techniques due to the simplicity, relative low cost and minimal space requirements of such a configuration.

As another example, phase shifter 126 may include phase shift module 132 coupled between first antenna 102 and second antenna 104 and radio assembly 134. Appropriate phase shifting may be achieved by phase shift module 132. As examples, phase shift module 132 may be an active phase shifter, a passive phase shifter, an analog phase shifter, a digital phase shifter or the like. Phase shift module 132 may be a separate component of antenna system 100 coupled between radio assembly 134 and first antenna 102 and second antenna 104, as illustrated in FIG. 1, or phase shift module 132 may be part of radio assembly 134.

Such an arrangement may allow antenna system 100 to overcome shadowing by splitting transmitted first frequency band 136, for example, VHF-High band (e.g., 118-174 MHz) power over two different antennas (e.g., first antenna 102 and second antenna 104) and/or reciprocally, combining received power from the two different antennas to provide for omnidirectional coverage. In VHF-Low band, for example, where width W of structure 108 is electrically small (e.g., in sub-wavelengths empirically determined depending on the application of antenna system 100 and/or the general shaping and/or material composition of structure 108), one antenna (e.g., first antenna 102), for example, at first end 110 (e.g., a leading edge), may be sufficient for omnidirectional coverage. As one example, width W may be considered electrically small where width W is smaller than one-tenth of a wavelength in width.

Referring to FIG. 1, as one example, first antenna 102 and second antenna 104 may each be configured to operate within first frequency band 136. Thus, both first antenna 102 and second antenna 104 may provide single band radiation. At least one of first antenna 102 and second antenna 104 may be further configured to operate within second frequency band 138. First frequency band 136 and second frequency band 138 may be different. Thus, at least one of first antenna 102 and second antenna 104 may provide single band radiation and at least one of first antenna 102 and second antenna 104 may provide multi-band radiation.

As used herein "at least one of" means any combination of single elements or any combination of multiple elements. As one general example, "at least one of element X, element Y and element Z" may include only element X, only element Y, only element Z, a combination of elements X and Y, a combination of elements X and Z, a combination of elements Y and Z, or a combination of elements X and Y and Z. As another general example, "at least one of X and Y" may include only element X, only element Y, or a combination of elements X and Y. As one specific example, "at least one of first antenna and second antenna" may include only first antenna, only second antenna, or a both first antenna and second antenna.

While FIG. 1 illustrates first antenna 102 being configured to operate within first frequency band 136 and second frequency band 138 (e.g., providing multi-band radiation) and second antenna 104 being configured to operate within first frequency band 136 (e.g., providing single band radiation), those skilled in the art will recognize that this configuration may be reversed.

As another example (not illustrated), first antenna 102 and second antenna 104 may each be configured to operate within first frequency band 136. At least one of first antenna 102 and second antenna 104 may be further configured to operate within second frequency band 138. At least one of first antenna 102 and second antenna 104 may be further configured to operate within at least one (e.g., one or more) additional (e.g., third, fourth, etc.) frequency band (not illustrated). First frequency band 136, second frequency band 138 and at least one additional frequency band each may be different. Thus, and as one example, one of first antenna 102 and second antenna 104 may provide single band radiation and one of first antenna 102 and second antenna 104 may provide multi-band radiation. As another example, first antenna 102 and second antenna 104 may each provide multi-band radiation.

Referring to FIGS. 3-6, and with reference to FIG. 1, as one example, first antenna 102 may include a plurality of first antenna elements 140 and second antenna 104 may include a plurality of second antenna elements 142. As one non-limiting example, each one of first antenna elements 140 and/or each one of second antenna elements 142 may include a stake monopole antenna. As one general, non-limiting example, each one of first antenna elements 140 and/or each one of second antenna elements 142 may include a planar strip of conductive (e.g., metal) material. As one specific, non-limiting example, each one of first antenna elements 140 and/or each one of second antenna elements 142 may include a flat strip of conductive foil. As one specific, non-limiting example, each one of first antenna elements 140 and/or each one of second antenna elements 142 may include a flat strip of highly conductive foil. As one specific, non-limiting example, each one of first antenna elements 140 and/or each one of second antenna elements 142 may include a flat strip of copper foil. As another specific, non-limiting example, each one of first antenna elements 140 and/or each one of second antenna elements 142 may be etched copper on a substrate such as polyimide film. As another specific, non-limiting example, each one of first antenna elements 140 and/or each one of second antenna elements 142 may include a layer of conductive paint or ink. As another specific, non-limiting example, each one of first antenna elements 140 and/or each one of second antenna elements 142 may include a dipole antenna when adequate space is available. In any of the examples provided herein, each one of first antenna elements 140 and/or each one of second antenna elements 142 may be shaped according to a particular application.

At least two of first antenna elements 140 may each include first length L1 and be configured to operate within first frequency band 136 (FIG. 2). At least two of second antenna elements 142 may each include first length L1 and be configured to operate within first frequency band 136. At least one of first antenna elements 140 and second antenna elements 142 may include second length L2 and be configured to operate within second frequency band 138 (FIG. 1). Optionally, at least one additional first antenna elements 140 and second antenna elements 142 may include an additional length and be configured to operate within an additional frequency band.

As one general, non-limiting example, and as illustrated in FIG. 3, first one 140*a* of first antenna elements 140 and second one 140*b* of first antenna elements 140 may include first length L1 and be configured to operate within first frequency band 136. First one 142*a* of second antenna elements 142 and second one 142*b* of second antenna elements 142 may include first length L1 and be configured to operate within first frequency band 136. Third one 140*c* of first antenna elements 140 may include second length L2 and be configured to operate within second frequency band 138. As one specific, non-limiting example, first length L1 of first one 140*a* and second one 140*b* of first antenna elements 140 and first one 142*a* and second one 142*b* of second antenna elements 142 may be approximately one-quarter (¼) of a wavelength at 75 MHz. Second length L2 of third one 140*c* of first antenna elements 140 may be approximately one-quarter (¼) of a wavelength at 200 MHz.

Thus, first one 140*a* and second one 140*b* first antenna elements 140 may provide for single band radiation of first antenna 102 (e.g., at first frequency band 136). First one 142*a* and second one 142*b* of second antenna elements 142 may provide for single band radiation of second antenna 104 (e.g., at first frequency band 136). Third one 140*c* one of first antenna elements 140 may provide for another single band radiation (e.g., at second frequency band 138) of first antenna 102. The combination of first one 140*a*, second one 140*b* and third one 140*c* of first antenna elements 140 may provide for multi-band radiation of first antenna 102 (e.g., at first frequency band 136 and second frequency band 138).

While FIG. 3 illustrates first antenna 102 including three first antenna elements 140 being configured to operate within first frequency band 136 and second frequency band 138 (e.g., providing multi-band radiation) and second antenna 104 including two second antenna elements 142 being configured to operate within first frequency band 136 (e.g., providing single band radiation), other configurations are also contemplated, for example, the example configuration may be reversed.

Figure 4:
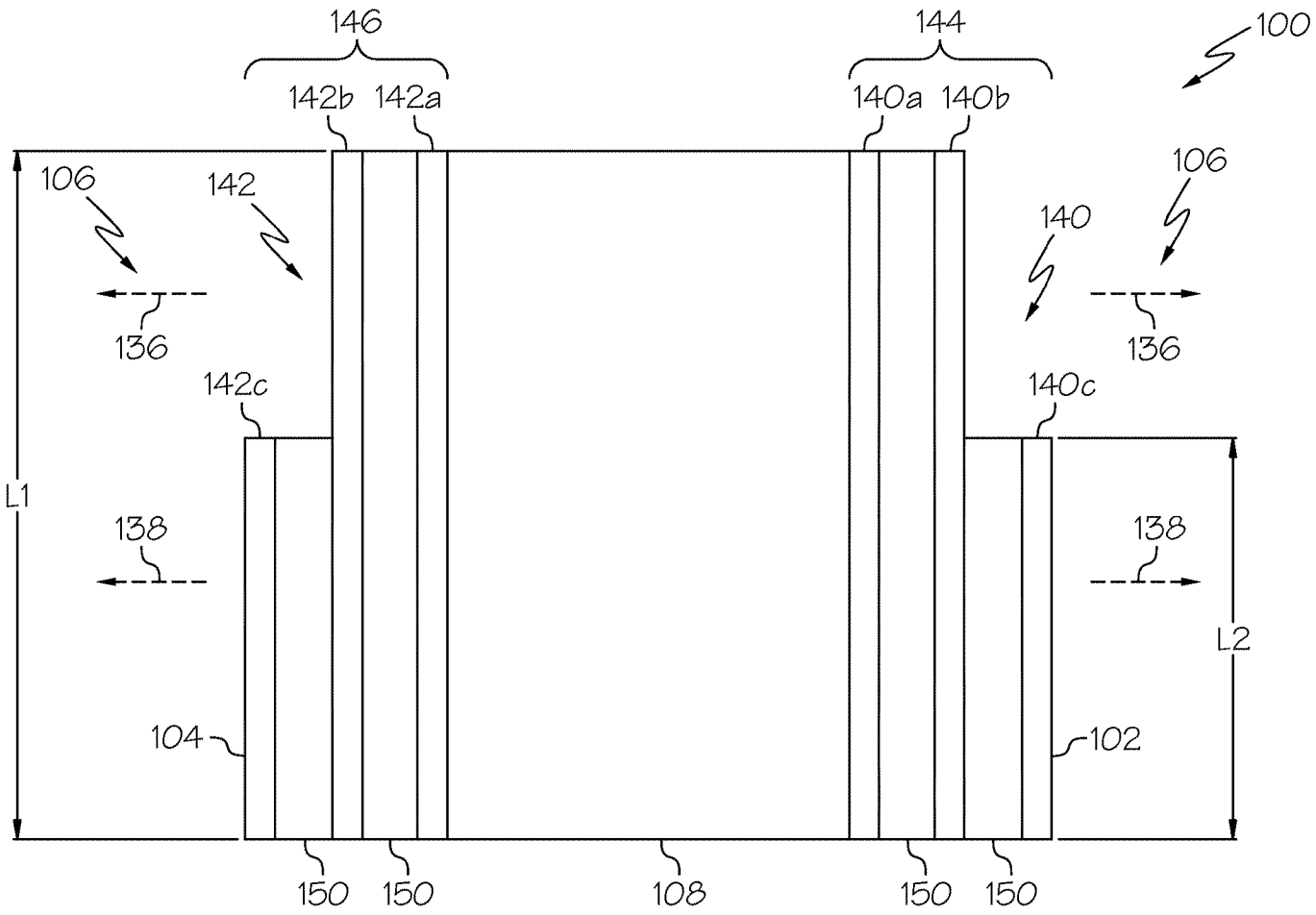
FIG. 4 is a schematic side elevational view of one embodiment of the antenna system of FIG. 1.

As another particular, non-limiting example, and as illustrated in FIG. 4, first one 140*a* of first antenna elements 140 and second one 140*b* of first antenna elements 140 may include first length L1 and be configured to operate within first frequency band 136. First one 142*a* of second antenna elements 142 and second one 142*b* of second antenna elements 142 may include first length L1 and be configured to operate within first frequency band 136. Third one 140*c* of first antenna elements 140 may include second length L2 and be configured to operate within second frequency band 138. Third one 142*c* of second antenna elements 142 may include second length L2 and be configured to operate within second frequency band 138.

Thus, first one 140*a* and second one 140*b* first antenna elements 140 may provide for single band radiation of first antenna 102 (e.g., at first frequency band 136). First one 142*a* and second one 142*b* of second antenna elements 142 may provide for single band radiation of second antenna 104 (e.g., at first frequency band 136). Third one 140*c* one of first antenna elements 140 may provide for another single band radiation (e.g., at second frequency band 138) of first antenna 102. Third one 142*c* one of second antenna elements 142 may provide for another single band radiation (e.g., at second frequency band 138) of second antenna 104. The combination of first one 140*a*, second one 140*b* and third one 140*c* of first antenna elements 140 may provide for multi-band radiation of first antenna 102 (e.g., at first frequency band 136 and second frequency band 138). The combination of first one 142*a*, second one 142*b* and third one 142*c* of second antenna elements 142 may provide for multi-band radiation of second antenna 104 (e.g., at first frequency band 136 and second frequency band 138).

Figure 5:
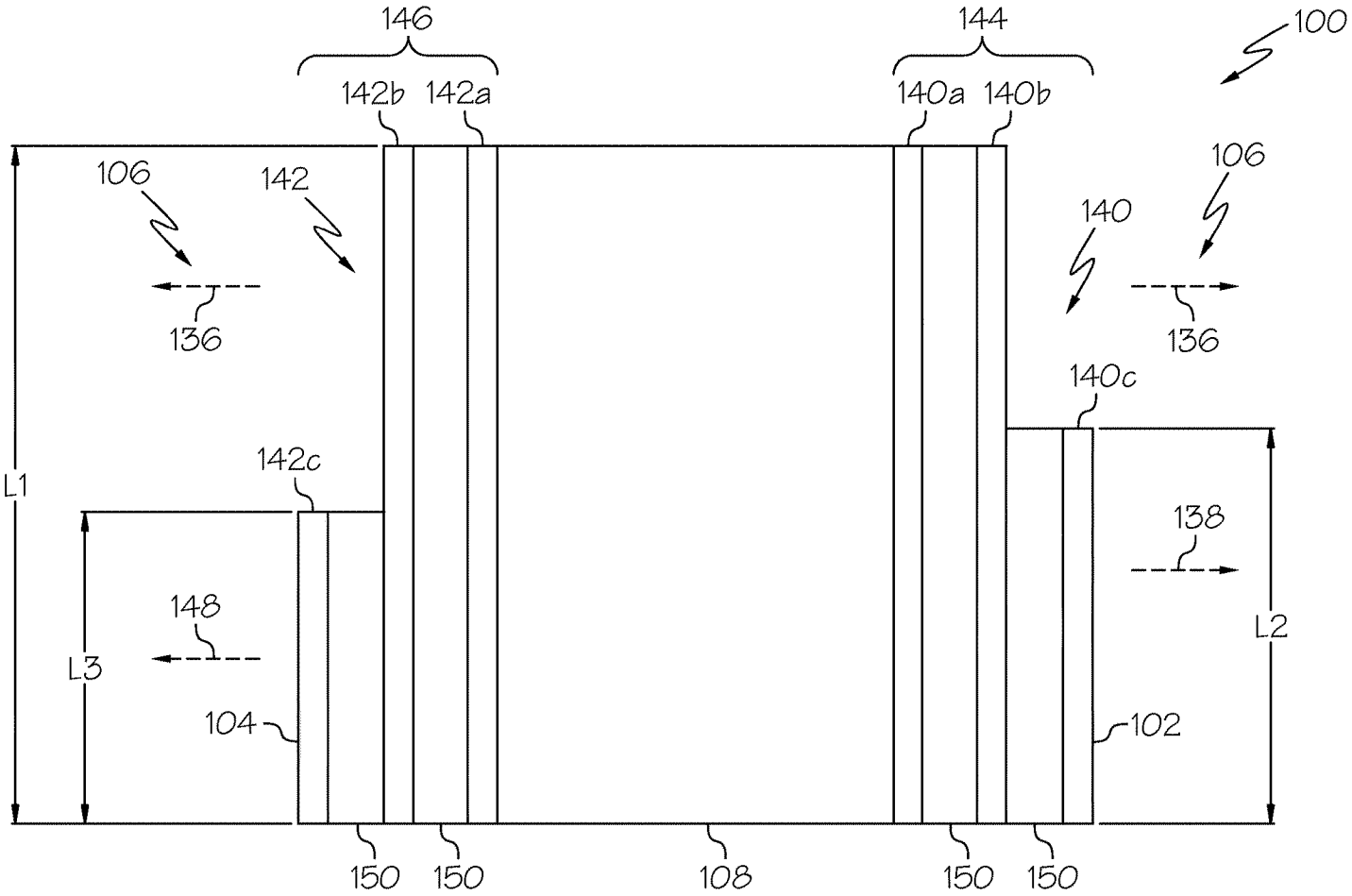
FIG. 5 is a schematic side elevational view of one embodiment of the antenna system of FIG. 1.

As another particular, non-limiting example, and as illustrated in FIG. 5, first one 140*a* of first antenna elements 140 and second one 140*b* of first antenna elements 140 may include first length L1 and be configured to operate within first frequency band 136. First one 142*a* of second antenna elements 142 and second one 142*b* of second antenna elements 142 may include first length L1 and be configured to operate within first frequency band 136. Third one 140*c* of first antenna elements 140 may include second length L2 and be configured to operate within second frequency band 138. Third one 142*c* of second antenna elements 142 may include third length L3 and be configured to operate within third frequency band 148.

Thus, first one 140*a* and second one 140*b* first antenna elements 140 may provide for single band radiation of first antenna 102 (e.g., at first frequency band 136). First one 142*a* and second one 142*b* of second antenna elements 142 may provide for single band radiation of second antenna 104 (e.g., at first frequency band 136). Third one 140*c* one of first antenna elements 140 may provide for another single band radiation (e.g., at second frequency band 138) of first antenna 102. Third one 142*c* one of second antenna elements 142 may provide for another single band radiation (e.g., at third frequency band 148) of second antenna 104. The combination of first one 140*a*, second one 140*b* and third one 140*c* of first antenna elements 140 may provide for multi-band radiation of first antenna 102 (e.g., at first frequency band 136 and second frequency band 138). The combination of first one 142*a*, second one 142*b* and third one 142*c* of second antenna elements 142 may provide for multi-band radiation of second antenna 104 (e.g., at first frequency band 136 and third frequency band 148).

Figure 6:
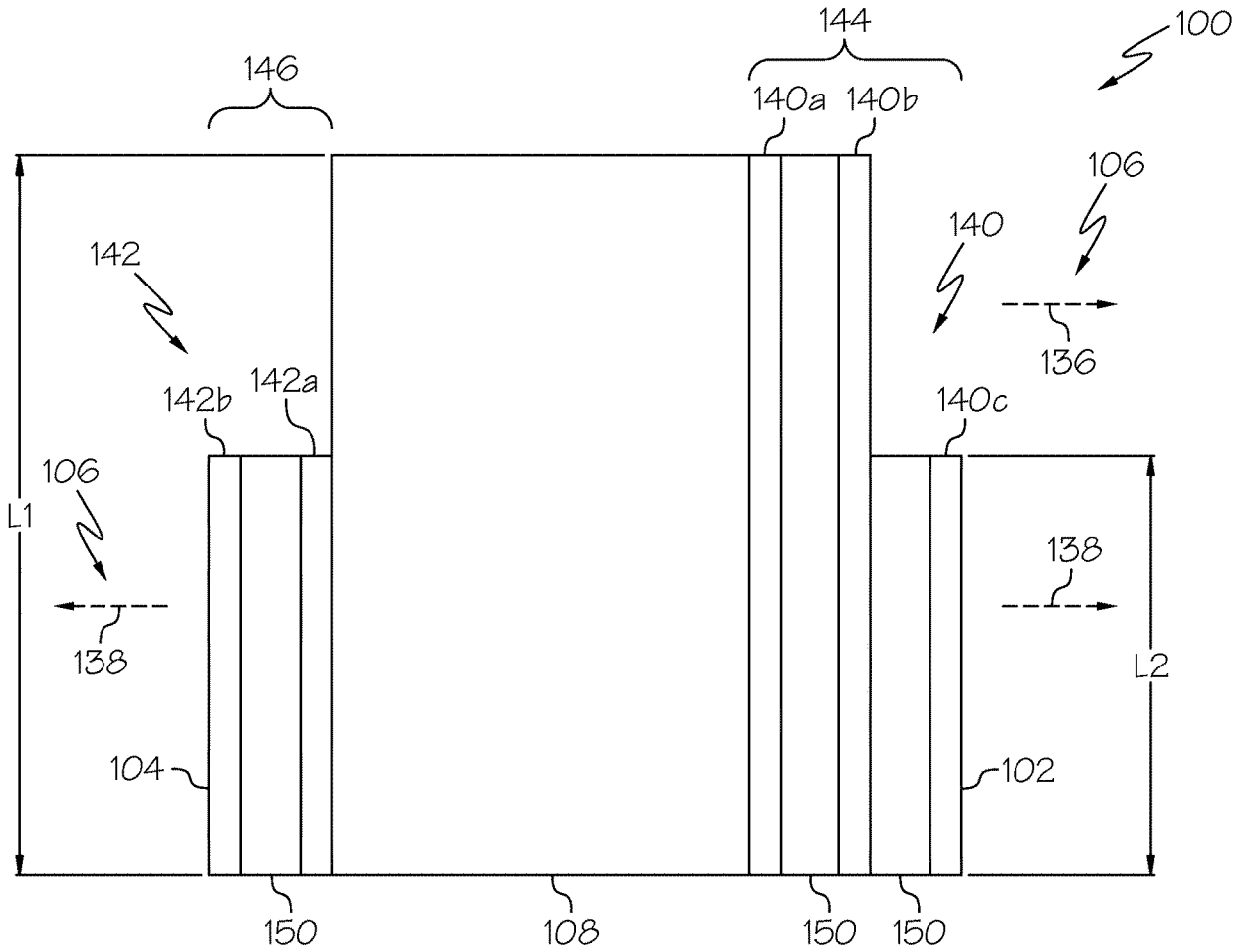
FIG. 6 is a schematic side elevational view of one embodiment of the antenna system of FIG. 1.

As another particular, non-limiting example, and as illustrated in FIG. 6, first one 140*a* of first antenna elements 140 and second one 140*b* of first antenna elements 140 may include first length L1 and be configured to operate within first frequency band 136. First one 142*a* of second antenna elements 142 and second one 142*b* of second antenna elements 142 may include first length L2 and be configured to operate within second frequency band 138. Third one 140*c* of first antenna elements 140 may include second length L2 and be configured to operate within second frequency band 138.

Thus, first one 140*a* and second one 140*b* first antenna elements 140 may provide for single band radiation of first antenna 102 (e.g., at first frequency band 136). First one 142*a* and second one 142*b* of second antenna elements 142 may provide for single band radiation of second antenna 104 (e.g., at second frequency band 138). Third one 140*c* one of first antenna elements 140 may provide for another single band radiation (e.g., at second frequency band 138) of first antenna 102. The combination of first one 140*a*, second one 140*b* and third one 140*c* of first antenna elements 140 may provide for multi-band radiation of first antenna 102 (e.g., at first frequency band 136 and second frequency band 138).

First length L1 may be dictated by first frequency band 136, second length L2 may be dictated by second frequency band 138, third length L3 may be dictated by third frequency band 148, etc. Generally, the length of the antenna (e.g., first antenna 102 and/or second antenna 104) may be one-quarter (¼) of a wavelength of the operating frequency of the antenna. As one example, first length L1 may be one-quarter (¼) of a wavelength of the, e.g., first, operating frequency of first frequency band 136, second length L2 may be one-quarter (¼) of a wavelength of the, e.g., second, operating frequency of second frequency band 138, third length L3 may be one-quarter (¼) of a wavelength of the, e.g., third, operating frequency of third frequency band 148, etc. First length L1, second length L2, third length L3, etc. may be different and, thus, first frequency band 136, second frequency band 138, third frequency band 148, etc. may be different.

First antenna elements 140 of first antenna 102 may be aligned in first antenna array 144. Second antenna elements 142 of second antenna 104 may be aligned in second antenna array 146. As used herein, the term "aligned" generally means that elements are arranged in a substantially straight line. As used herein, the term "substantially" generally means being within a manufacturing tolerance.

As one example, first antenna elements 140 of first antenna 102 may be arranged (e.g., stacked) in a substantially straight line and second antenna elements 142 of second antenna 104 may be arranged (e.g., stacked) in a substantially straight line. First antenna elements 140 and/or second antenna elements 142 having the largest (e.g., longest) length (e.g., first one 140*a* and second one 140*b* of first antenna elements 140 and/or first one 142*a* and second one 142*b* of second antenna elements 142 having first length L1, as illustrated in FIG. 3) may be inner antenna elements. First antenna elements 140 and/or second antenna elements 142 having lesser (e.g., shorter) lengths (e.g., third one 140*c* of first antenna elements 140 having second length L2, as illustrated in FIG. 3) may be outer antenna elements.

As used herein, "inner" generally refers to the antenna element (or elements) disposed or positioned closest to the structure to which the antenna is coupled (e.g., structure 108). As used herein, "outer" generally refers to the antenna element (or elements) disposed or positioned outwardly from the inner element (or elements) and farther away from the structure to which the antenna is coupled.

As one example, and as best illustrated in FIG. 3, first one 140*a* and second one 140*b* of first antenna elements 140 having first length L1 may be the inner antenna elements of first antenna 102 (e.g., of first antenna array 144) and third one 140*c* of first antenna elements 140 having second length L2 may be the outer antenna element of first antenna 102 (e.g., of first antenna array 144). First one 142*a* and second one 142*b* of second antenna elements 142 having first length L1 may be the inner antenna elements of second antenna 104 (e.g., of second antenna array 146).

As another example, and as best illustrated in FIG. 4, first one 140*a* and second one 140*b* of first antenna elements 140 having first length L1 may be the inner antenna elements of first antenna 102 (e.g., of first antenna array 144) and third one 140*c* of first antenna elements 140 having second length L2 may be the outer antenna element of first antenna 102 (e.g., of first antenna array 144). First one 142*a* and second one 142*b* of second antenna elements 142 having first length L1 may be the inner antenna elements of second antenna 104 (e.g., of second antenna array 146) and third one 142*c* of second antenna elements 142 having second length L2 may be the outer antenna element of second antenna 104 (e.g., of second antenna array 146).

As another example, and as best illustrated in FIG. 5, first one 140*a* and second one 140*b* of first antenna elements 140 having first length L1 may be the inner antenna elements of first antenna 102 (e.g., of first antenna array 144) and third one 140*c* of first antenna elements 140 having second length L2 may be the outer antenna element of first antenna 102 (e.g., of first antenna array 144). First one 142*a* and second one 142*b* of second antenna elements 142 having first length L1 may be the inner antenna elements of second antenna 104 (e.g., of second antenna array 146) and third one 142*c* of second antenna elements 142 having second length L3 may be the outer antenna element of second antenna 104 (e.g., of second antenna array 146).

As another example, and as illustrated in FIG. 6, first one 140*a* and second one 140*b* of first antenna elements 140 having first length L1 may be the inner antenna elements of first antenna 102 (e.g., of first antenna array 144) and third one 140*c* of first antenna elements 140 having second length L2 may be the outer antenna element of first antenna 102 (e.g., of first antenna array 144). First one 142*a* and second one 142*b* of second antenna elements 142 having second length L2 may be the inner antenna elements of second antenna 104 (e.g., of second antenna array 146).

The innermost antenna elements of each antenna array (e.g., first antenna array 144 and/or second antenna array 146) may include the greatest (e.g., longest) length and may be configured to operate within the lowest operating frequency band of that array. The innermost antenna elements of each antenna array may typically include two antenna elements of the same length in order to ensure proper function of the antenna (e.g., to prevent shorting out with the ground plane). The outermost antenna element of each antenna array may include the least (e.g., shortest) length and may be configured to operate within the highest frequency band. Any additional antenna elements disposed between the innermost antenna elements and the outermost antenna element of each antenna array may have intermediate lengths configured to operate within intermediate operating frequency bands. As one example, each successive outer antenna element may include a lesser length than an immediately prior inner antenna element and may provide a different operating frequency (e.g., an additional frequency band).

While the example of FIG. 3 illustrates first antenna 102 including first antenna array 144 having three antenna elements 140 configured to provide two operating frequencies and second antenna 104 including second antenna array 146 having two antenna elements 142 configured to provide one operating frequency, one or both of first antenna array 144 and/or second antenna array 146 may include additional antenna elements configured to provide additional operating frequencies, as illustrated in FIGS. 4-6.

As one example, first antenna array 144 may include first one 140*a* and second one 140*b* of first antenna elements 140 having first length L1 and configured to operate within first frequency band 136, third one 140*c* of first antenna elements 140 having second length L2 different than (e.g., less than) first length L1 and configured to operate within second frequency band 138 different than (e.g., higher than) first frequency band 136, fourth one (not illustrated) of first antenna elements 140 having third length different than (e.g., less than) first length L1 and second length L2 and configured to operate within third frequency band different than (e.g., higher than) first frequency band 136 and second frequency band 138, fifth one (not illustrated) of first antenna elements 140 having fourth length different than (e.g., less than) first length L1, second length L2 and third length and configured to operate within fourth frequency band different than (e.g., higher than) first frequency band 136, second frequency band 138 and third frequency band, etc.

As one example, second antenna array 146 may include first one 142*a* and second one 142*b* of second antenna elements 142 having first length L1 and configured to operate within first frequency band 136, third one 142*c* of second antenna elements 142 having second length L2 different than (e.g., less than) first length L1 and configured to operate within second frequency band 138 different than (e.g., higher than) first frequency band 136, fourth one (not illustrated) of second antenna elements 142 having third length L3 different than (e.g., less than) first length L1 and second length L2 and configured to operate within third frequency band 148 different than (e.g., higher than) first frequency band 136 and second frequency band 138, fifth one (not illustrated) of second antenna elements 142 having fourth length different than (e.g., less than) first length L1, second length L2 and third length L3 and configured to operate within fourth frequency band different than (e.g., higher than) first frequency band 136, second frequency band 138 and third frequency band 148, etc.

Opposed first antenna elements 140 and second antenna elements 142 having the same length may provide the omnidirectional radiation pattern.

The shadowing effect of a structure (e.g., structure 108) on the radiation pattern (e.g., first radiation pattern 114 and/or second radiation pattern 116) of an antenna (e.g., first antenna 102 and/or second antenna 104), for example, nulls (e.g., first null 118 and/or second null 120) created by the structure, may be less at lower frequency bands (e.g., longer wavelengths) relative to the thickness and/or structural shaping of the structure (e.g., thickness T of structure 108). Thus, an antenna (e.g., an antenna element) operating at a sufficiently low frequency band relative to the thickness of the structure may provide omnidirectional coverage without the need for a corresponding opposed antenna (e.g., an opposed antenna element of the same length). Therefore, and without being limited to any particular theory, when thickness T of structure 108 is less than approximately one-tenth (1/10) of a wavelength of the operating frequency of a particular antenna element of one antenna, only the one antenna may be required to provide the omnidirectional radiation pattern.

As one example, and as illustrated in FIG. 3, first one 140*a* and second one 140*b* of first antenna elements 140 of first antenna 102 may radiate electromagnetic radiation 106 at first frequency band 136. First one 142*a* and second one 142*b* of second antenna elements 142 of second antenna 104 may radiate electromagnetic radiation 106 at first frequency band 136. First frequency band 136 may be sufficiently high, for example, relative to thickness T of structure 108, that both first antenna 102 and second antenna 104 may be required to provide the omnidirectional radiation pattern (e.g., omnidirectional coverage of first frequency band 136). Third one 140*c* of first antenna elements 140 may radiate electromagnetic radiation 106 at second frequency band 138. Second frequency band 138 may be sufficiently low, for example, relative to thickness T of structure 108, that only first antenna 102 may be required to provide the omnidirectional radiation pattern (e.g., omnidirectional coverage of second frequency band 138).

As another example, as illustrated in FIG. 4, first one 140*a* and second one 140*b* of first antenna elements 140 of first antenna 102 may radiate electromagnetic radiation 106 at first frequency band 136. First one 142*a* and second one 142*b* of second antenna elements 142 of second antenna 104 may radiate electromagnetic radiation 106 at first frequency band 136. First frequency band 136 may be sufficiently high, for example, relative to thickness T of structure 108, that both first antenna 102 and second antenna 104 may be required to provide the omnidirectional radiation pattern (e.g., omnidirectional coverage of first frequency band 136). Third one 140*c* of first antenna elements 140 may radiate electromagnetic radiation 106 at second frequency band 138. Second frequency band 138 may be sufficiently high, for example, relative to thickness T of structure 108, that structure 108 may create first null 118 in first radiation pattern 114 (FIG. 2) of third one 140*c* of first antenna elements 140. Therefore, third one 142*c* of second antenna elements 142 having second length L2 (e.g., the same length as third one 142*c* of first antenna elements 140) may be required to provide the omnidirectional radiation pattern (e.g., omnidirectional coverage of second frequency band 138).

As another example, and as illustrated in FIG. 5, first one 140*a* and second one 140*b* of first antenna elements 140 of first antenna 102 may radiate electromagnetic radiation 106 at first frequency band 136. First one 142*a* and second one 142*b* of second antenna elements 142 of second antenna 104 may radiate electromagnetic radiation 106 at first frequency band 136. First frequency band 136 may be sufficiently high, for example, relative to thickness T of structure 108, that both first antenna 102 and second antenna 104 may be required to provide the omnidirectional radiation pattern (e.g., omnidirectional coverage of first frequency band 136). Third one 140*c* of first antenna elements 140 may radiate electromagnetic radiation 106 at second frequency band 138. Second frequency band 138 may be sufficiently low, for example, relative to thickness T of structure 108, that only first antenna 102 may be required to provide the omnidirectional radiation pattern (e.g., omnidirectional coverage of second frequency band 138). Third one 142*c* of second antenna elements 142 may radiate electromagnetic radiation 106 at third frequency band 148. Third frequency band 148 may be sufficiently low, for example, relative to thickness T of structure 108, that only second antenna 104 may be required to provide the omnidirectional radiation pattern (e.g., omnidirectional coverage of third frequency band 148).

As another example, and as illustrated in FIG. 6, first one 140*a* and second one 140*b* of first antenna elements 140 of first antenna 102 may radiate electromagnetic radiation 106 at first frequency band 136. First frequency band 136 may be sufficiently low, for example, relative to thickness T of structure 108, that only first antenna 102 may be required to provide the omnidirectional radiation pattern (e.g., omnidirectional coverage of first frequency band 136). First one 142*a* and second one 142*b* of second antenna elements 142 of second antenna 104 may radiate electromagnetic radiation 106 at second frequency band 138. Second frequency band 138 may be sufficiently high, for example, relative to thickness T of structure 108, that structure 108 may create second null 120 in second radiation pattern 116 (FIG. 2) of first one 142*a* and second one 142*b* of second antenna elements 142. Therefore, third one 140*c* of first antenna elements 140 having second length L2 (e.g., the same length as first one 142*a* and second one 142*b* of second antenna elements 142) may be required to provide the omnidirectional radiation pattern (e.g., omnidirectional coverage of second frequency band 138).

While the examples illustrated in FIGS. 3-6 illustrate first antenna 102 radiating electromagnetic radiation 106 at one or more of first frequency band 136 and second frequency band 138 and second antenna 104 radiating electromagnetic radiation 106 at one or more of first frequency band 136, second frequency band 138 and third frequency band 148, other configurations are also contemplated. As one example, first antenna 102 may radiate electromagnetic radiation 106 at first frequency band 136, second frequency band 138 and third frequency band 148 and second antenna 104 may radiate electromagnetic radiation 106 at first frequency band 136. As another example, first antenna 102 may radiate electromagnetic radiation 106 at first frequency band 136 and second antenna 104 may radiate electromagnetic radiation 106 at first frequency band 136, second frequency band 138 and third frequency band 148. As another example, first antenna 102 may radiate electromagnetic radiation 106 at first frequency band 136 and second frequency band 138 and second antenna 104 may radiate electromagnetic radiation 106 at first frequency band 136, second frequency band 138 and third frequency band 148.

Referring to FIGS. 3 and 4, as one specific, non-limiting example, third one 140*c* of first antenna elements 140 may be configured (e.g., may include a predetermined length L2) to operate within second frequency band 138 of between approximately 3 MHz to 400 MHz (e.g., very high frequency ("VHF")) having a wavelength of between approximately ten meters and one meter and, more particularly a wavelength of two meters. When thickness T of structure 108 is less than one-tenth of the wavelength of second frequency band 138, or approximately 20 centimeters (approximately 8 inches), third one 140*c* of first antenna elements 140 of first antenna 102 may provide omnidirectional coverage of second frequency band 138, as illustrated in FIG. 3. When thickness T of structure 108 is greater than one-tenth of the wavelength of second frequency band 138, or approximately 20 centimeters (approximately 8 inches), third one 140*c* of first antenna elements 140 of first antenna 102 and third one 142*c* of second antenna elements 142 of second antenna 104 may be required to provide omnidirectional coverage of second frequency band 138, as illustrated in FIG. 4.

Referring to FIGS. 3-6, first antenna elements 140 (e.g., first antenna array 144) may be physically separated from second antenna elements 142 (e.g., second antenna array 146) by structure 108. Each one of first antenna elements 140 may be physically separated from another one of first antenna elements 140. As one example, each first antenna element 140 of first antenna array 144 may be physically separated from an immediately adjacent first antenna element 140 of first antenna array 144. Each one of second antenna elements 142 may be physically separated from another one of second antenna elements 142. As one example, each second antenna element 142 of second antenna array 146 may be physically separated from an immediately adjacent second antenna element 142 of second antenna array 146.

Generally, the performance of first antenna 102 is not dependent upon the separation distance of adjacent first antenna elements 140. Similarly, the performance of second antenna 104 is not dependent upon the separation distance of adjacent second antenna elements 142. Generally, the separation distance (e.g., minimum separation distance) between adjacent first antenna elements 140 and minimum separation distance between adjacent second antenna elements 142 may be dictated, for example, by the respective operating frequencies of first antenna 102 (or first antenna elements 140) and second antenna 104 (or second antenna elements 142). As one example, the minimum separation distance between adjacent first antenna elements 140 and minimum separation distance between adjacent second antenna elements 142 may be less for lower frequencies and may be greater for higher frequencies. As one specific, non-limiting example, the minimum separation distance between adjacent first antenna elements 140 and/or the minimum separation distance between adjacent second antenna elements 142 may be approximately 0.01 inch (0.25 millimeters) to approximately 0.1 inch (e.g., 2.54 millimeters).

Referring still to FIGS. 3-6, as one example, each one of first antenna elements 140 may be physically separated from another one of first antenna elements 140 by dielectric material 150. Similarly, each one of second antenna elements 142 may be physically separated from another one of second antenna elements 142 by dielectric material 150. As one general, non-limiting example, dielectric material 150 may be any dielectric material having a low dielectric constant (also referred to as a low dielectric material). As one example, a low dielectric constant may include a dielectric constant of less than approximately 6. As another example, a low dielectric constant may include a dielectric constant of less than approximately 3. As another example, a low dielectric constant may include a dielectric constant of less than approximately 2. As another example, a low dielectric constant may include a dielectric of approximately 1. As one specific, non-limiting example, dielectric material 150 may include dry air. As another specific, non-limiting example, dielectric material 150 may include a dielectric weave. As another specific, non-limiting example, dielectric material 150 may include an adhesive, for example, a plastic adhesive. As another specific, non-limiting example, dielectric material 150 may include fiberglass, for example, a fiberglass sheet. As another example, dielectric material 150 may include quartz, for example, a sheet of quartz. As another example, dielectric material 150 may include a composite, for example, glass fiber-reinforced polymer ("GFRP"). As another specific, non-limiting example, dielectric material 150 may include plastic, for example, a polyethylene, polyvinyl chloride and the like.

Each one of first antenna elements 140 may be include a width (not explicitly illustrated). Each one of second antenna elements 142 may include a width (not explicitly illustrated). The width of a particular antenna element (e.g., each one of first antenna elements 140 and/or each one of second antenna elements 142) may vary.

Generally, and without being limited to any particular theory, the width of a particular antenna element may provide for bandwidth control of an associated antenna. Thus, the width may be varied to achieve a desired bandwidth. As one example, the width of any one of first antenna elements 140 may provide for bandwidth control of first antenna 102 (or of the particular one of first antenna elements 140). As another example, the width of any one of second antenna elements 142 may provide for bandwidth control of second antenna 104 (or of the particular one of second antenna elements 142). Further, and without being limited to any particular theory, an increase in width, for example, of a particular antenna element, may increase the efficiency of the associated antenna.

As one general, non-limiting example, one of first antenna elements 140 and/or one of second antenna elements 142 having a greater length and configured to operate within lower frequency bands (e.g., having longer wavelengths) may include a greater width than another one of first antenna elements 140 and/or another one of second antenna elements 142 having a lesser length and configured to operate within higher frequency bands (e.g., having shorter wavelengths). As one specific, non-limiting example, and as best illustrated in FIG. 3, first one 140*a* and second one 140*b* of first antenna elements 140 may have a greater width than third one 140*c* of first antenna elements 140.

Referring to FIG. 1, radio assembly 134 may transmit outgoing signals 154 to first antenna 102 and second antenna 104. Radio assembly 134 may receive incoming signals 156 from first antenna 102 and second antenna 104. Outgoing signals 154 and incoming signals 156 may be radio signals carried through feed line 158 to and from first antenna 102 and second antenna 104. Feed line 158 may include one or more signal conductors. Those skilled in the art will recognize that when first feed line 128, having first length l1, and second feed line 130, having length l2, are being used as phase shifter 126, first feed line 128 and second feed line 130 may be a portion of (e.g., a length of) feed line 158.

Antenna system 100 may include signal router 152. Signal router 152 may be coupled between first antenna 102 and second antenna 104 and radio assembly 134, for example, via feed line 158. Signal router 152 may properly distribute (e.g., split) outgoing signals 154 from radio assembly 134 to first antenna 102 and/or second antenna 104. Signal router 152 may properly distribute (e.g., combine) incoming signals 156 from first antenna 102 and/or second antenna 104 to radio assembly 134.

As one example, one or more of outgoing signals 154 may include different frequencies. As one example, radio assembly 134 may transmit one of outgoing signals 154 in first frequency band 136 and another one of outgoing signals 154 in second frequency band 138. Signal router 152 may split the one of outgoing signals 154 in first frequency band 136 into a first portion and a second portion. The first portion of the one of outgoing signals 154 in first frequency band 136 may be transmitted to second antenna 104. Signal router 152 may combine the second portion of the one of outgoing signals 154 in first frequency band 136 and the another one of outgoing signals 154 in second frequency band 138 to be transmitted to first antenna 102.

As another example, one or more incoming signals 156 may include different frequencies. As one example, one of incoming signals 156 in first frequency band 136 and another one of incoming signals 156 in second frequency band 138 may be received from first antenna 102. Yet another one of incoming signals 156 in first frequency band 136 may be received from second antenna 104. Signal router 152 may split the one of incoming signals 156 in first frequency band 136 and another one of incoming signals 156 in second frequency band 138. Signal router 152 may combine the one of incoming signals 156 in first frequency band 136 and the yet another one of incoming signals 156 in first frequency band 136 to be received by radio assembly 134. The another one of incoming signals 156 in second frequency band 138 may be received by radio assembly 134.

Additional outgoing signals 154 and/or incoming signals 156 are also contemplated depending, for example, on the particular application of antenna system 100, the number of different operating frequencies (e.g., first frequency band 136, second frequency band 138, third frequency band 148, etc.) of first antenna 102 and/or second antenna 104 and the like. Accordingly, signal router 152 may be configured to properly distribute outgoing signals 154 from radio assembly 134 to first antenna 102 and/or second antenna 104 and/or properly distribute incoming signals 156 from first antenna 102 and/or second antenna 104 to radio assembly 134.

Signal router 152 may include a variety of components configured to properly distribute outgoing signals 154 and/or incoming signals 156. As one example, and as illustrated in FIG. 7, signal router 152 may include power splitter 176, multiplexer 182, power combiner 184 and/or demultiplexer 186. Those skilled in the art will recognize that the configuration of signal router 152 may depend, for example, on the particular application of antenna system 100.

Referring to FIG. 7, and with reference to FIG. 1, as one example, radio assembly 134 may include first radio 160 and second radio 162. First radio 160 and second radio 162 may be configured to operate at different frequencies (e.g., within different frequency bands). As one example, first radio 160 may be configured to operate within first frequency band 136 (FIG. 1) and second radio 162 may be configured to operate within second frequency band 138 (FIG. 1).

As one general, non-limiting example, first radio 160 and/or second radio 162 (and first antenna 102 and/or second antenna 104) may include an operating frequency (e.g., a frequency band) of approximately 3 MHz to approximately 100 GHz. As another general, non-limiting example, first radio 160 and/or second radio 162 (and first antenna 102 and/or second antenna 104) may include an operating frequency of approximately 30 MHz to approximately 400 MHz. As another general, non-limiting example, first radio 160 and/or second radio 162 (and first antenna 102 and/or second antenna 104) may include an operating frequency of approximately 30 MHz to approximately 174 MHz. As another general, non-limiting example, first radio 160 and/or second radio 162 (and first antenna 102 and/or second antenna 104) may include an operating frequency of approximately 225 MHz to approximately 400 MHz. As one specific, non-limiting example, first radio 160 may be a VHF-High radio, for example, including an operating frequency of approximately 118 MHz to approximately 174 MHz. As one specific, non-limiting example, second radio 162 may be a VHF-Low Radio, for example, including an operating frequency of approximately 30 MHz to approximately 88 MHz.

Referring still to FIG. 7, and with reference to FIG. 1, first radio 160 may include first radio transmitter 164 and first radio receiver 166. Second radio 162 may include second radio transmitter 168 and second radio receiver 170. First radio transmitter 164 may transmit first outgoing signal 172. Second radio transmitter 168 may transmit second outgoing signal 174. First outgoing signal 172 and second outgoing signal 174 may have different operating frequencies. As one example, first outgoing signal 172 may be in first frequency band 136 (FIG. 1) and second outgoing signal 174 may be in second frequency band 138 (FIG. 1).

First outgoing signal 172 may be directed from first radio transmitter 164 to power splitter 176 (e.g., power splitter 176 may receive first outgoing signal 172 from first radio transmitter 164). Power splitter 176 may split first outgoing signal 172 into third outgoing signal 178 in first frequency band 136 (FIG. 1) and fourth outgoing signal 180 in first frequency band 136. As one general, non-limiting example, power splitter 176 may be any device configured to divide a defined amount of electromagnetic power to enable a signal to be used in two circuits, for example, to allow one radio (e.g., first radio 160) to feed two antennas (e.g., first antenna 102 and second antenna 104). As one specific, non-limiting example, power splitter 176 may be a VHF power splitter rated for 50 W.

One or more additional power splitters (not illustrated) may be utilized with antenna system 100 when one or more additional radios (e.g., additional radio transmitters) (not illustrated) feed additional outgoing signals (not illustrated) to first antenna 102 and second antenna 104. The number of power splitters utilized and the configuration may depend, for example, on the particular application of antenna system 100, the number of operating frequencies (e.g., first frequency band 136, second frequency band 138, third frequency band 148, etc.) (FIG. 1) of first antenna 102 and/or second antenna 104 and the like.

Referring still to FIG. 7, and with reference to FIG. 1, third outgoing signal 178 may be directed from power splitter 176 to second antenna 104 (e.g., second antenna 104 may receive third outgoing signal 178 from power splitter 176). Fourth outgoing signal 180 may be directed from power splitter 176 to multiplexer 182 (e.g., multiplexer 182 may receive fourth outgoing signal 180 from power splitter 176). Second outgoing signal 174 may be directed from second radio transmitter 168 to multiplexer 182 (e.g., multiplexer 182 may receive second outgoing signal 174 from second radio transmitter 168).

Multiplexer 182 may receive second outgoing signal 174 and fourth outgoing signal 180. Multiplexer 182 may combine second outgoing signal 174 and fourth outgoing signal 180 into fifth outgoing signal 188. Fifth outgoing signal 188 may be in first frequency band 136 and second frequency band 138 (FIG. 1). For example, fifth outgoing signal 188 may be a combination of second outgoing signal 174 in second frequency band 138 and fourth outgoing signal 180 in first frequency band 136. As one general, non-limiting example, multiplexer 182 may be any device configured to combine two or more signals of different frequencies into one signal without interfering with each other, for example, to allow two or more radios (e.g., first radio 160 and second radio 162) to feed one antenna (e.g., first antenna 102). As one example, and as illustrated in FIG. 7, multiplexer 182 may be a diplexer configured to allow first radio 160 (e.g., first radio transmitter 164) and second radio 162 (e.g., second radio transmitter 168) to feed first antenna 102. As another example (not illustrated), multiplexer 182 may be a triplexer configured to allow first radio 160, second radio 162 and third radio (not illustrated), for example, configured to transmit outgoing signal in third frequency band, to feed first antenna 102. Those skilled in the art will recognize that the type of multiplexer 182 and/or the number of multiplexers 182 may depend, for example, on the number of radios of radio assembly 134 and/or the number of operating frequencies of the feed antenna (e.g., first antenna 102 or second antenna 104).

Referring still to FIG. 7, and with reference to FIG. 1, first incoming signal 190 may be gained from first antenna 102. Second incoming signal 192 may be gained from second antenna 104. First incoming signal 190 and second incoming signal 192 may have different operating frequencies. As one example, first incoming signal 190 may be in first frequency band 136 (FIG. 1) and second frequency band 138 (FIG. 1) and second incoming signal 192 may be in first frequency band 136. As one example, first incoming signal 190 may be a combination of a radio signal in first frequency band 136 received by first antenna 102 and a radio signal in second frequency band 138 received by first antenna 102. Second incoming signal 192 may be a radio signal in first frequency band 136 received by second antenna 104.

First incoming signal 190 may be directed from first antenna 102 to demultiplexer 186 (e.g., demultiplexer 186 may receive first incoming signal 190 from first antenna 102). Demultiplexer 186 may split first incoming signal 190 into third incoming signal 194 in first frequency band 136 (FIG. 1) and fourth incoming signal 196 in second frequency band 138 (FIG. 1). As one general, non-limiting example, demultiplexer 186 may be any device configured to split one signal having different frequencies into two or more signals each having a different frequency, for example, to allow one antenna (e.g., first antenna 102) to feed two or more radios (e.g., first radio 160 and second radio 162). As one example, and as illustrated in FIG. 7, demultiplexer 186 may be configured to allow first antenna 102 to feed first radio 160 (e.g., first radio receiver 166) and second radio 162 (e.g., second radio receiver 170). As another example (not illustrated), demultiplexer 186 may be configured to allow first antenna 102 to feed first radio 160, second radio 162 and third radio (not illustrated), for example, configured to receive outgoing signal in third frequency band. Those skilled in the art will recognize that the type of demultiplexer 186 and/or the number of demultiplexers 186 may depend, for example, on the number of radios of radio assembly 134 and/or the number of operating frequencies of the feed antenna (e.g., first antenna 102 or second antenna 104).

Multiplexer 182 and demultiplexer 186 may complement each other. As one example, multiplexer 182 may be on the transmitting end of a signal and demultiplexer 186 may be on the receiving end of the signal. Multiplexer 182 and demultiplexer 186 may be combined into a single unit or component of signal router 152.

Referring still to FIG. 7, and with reference to FIG. 1, second incoming signal 192 may be directed from second antenna 104 to power combiner 184 (e.g., power combiner 184 may receive second incoming signal 192 from second antenna 104). Third incoming signal 194 may be directed from demultiplexer 186 to power combiner 184 (e.g., power combiner 184 may receive third incoming signal 194 from demultiplexer 186). Power combiner 184 may combine second incoming signal 192 and third incoming signal 194 into fifth incoming signal 198 in first frequency band 136 (FIG. 1). As one general, non-limiting example, power combiner 184 may be any device configured to combine electromagnetic power to enable a signal from two circuits, for example, to allow two antennas (e.g., first antenna 102 and second antenna 104) to feed one radio (e.g., first radio 160).

Power splitter 176 and power combiner 184 may complement each other. As one example, power splitter 176 may be on the transmitting end of a signal and power combiner 184 may be on the receiving end of the signal. Power splitter 176 and power combiner 184 may be combined into a single unit or component of signal router 152.

Fourth incoming signal 196 may be directed from demultiplexer 186 to second radio receiver 170 (e.g., second radio receiver 170 may receive fourth incoming signal 196 from demultiplexer 186). Fifth incoming signal 198 may be directed from power combiner 184 to first radio receiver 166 (e.g., first radio receiver 166 may receive fifth incoming signal 198 from power combiner 184).

Referring to FIG. 7, antenna system 100 may include amplifier 200. Amplifier 200 may be coupled between second radio receiver 170 and demultiplexer 186. Amplifier 200 may be coupled between second radio transmitter 168 and multiplexer 182. Amplifier 200 may increase the gain of second outgoing signal 174 and/or fourth incoming signal 196. Additional amplifiers (not illustrated) may also be utilized.

Referring to FIG. 7, and with reference to FIG. 1, while not explicitly illustrated in FIG. 7, the various components of antenna system 100 (e.g., first radio 160, second radio 162, power splitter 176, power combiner 184, multiplexer 182, demultiplexer 186, first antenna 102, second antenna 104 and/or amplifier 200) may be coupled together via feed line 158 (FIG. 1). Any signals (e.g., first outgoing signal 172, second outgoing signal 174, third outgoing signal 178, fourth outgoing signal 180, fifth outgoing signal 188, first incoming signal 190, second incoming signal 192, third incoming signal 194, fourth incoming signal 196 and/or fifth incoming signal 198) may be fed through feed line 158. As one example, first feed line 128 (FIG. 1) may be a portion of feed line 158 coupling first radio 160 and second radio 162 to first antenna 102. As one example, second feed line 130 (FIG. 1) may be a portion of feed line 158 coupling first radio 160 to second antenna 104. When first feed line 128 is used as phase shifter 126 (FIG. 1), the portion of first feed line 128 defining first length l1 (FIG. 1) may be the overall length of first feed line 128 from first radio 160 and second radio 162 to first antenna 102 or may be a portion of the overall length, for example, from signal router 152 to first antenna 102. When second feed line 130 is used as phase shifter 126 (FIG. 1), the portion of second feed line 130 defining second length l2 (FIG. 1) may be the overall length of second feed line 130 from second radio 162 to second antenna 104 or may be a portion of the overall length, for example, from signal router 152 to second antenna 104.

The example embodiment of signal router 152 illustrated in FIG. 7 is not meant to imply physical or architectural limitations to the manner in which different example embodiment may be implemented. Other features in addition to and/or in place of the ones illustrated may be used. Some features may be unnecessary in some example embodiments. Also, some of the blocks are presented to illustrate some functional features. One or more of these blocks may be combined and/or divided into different blocks when implemented in different example embodiments. As one example, power splitter 176 and/or power combiner 184 may be disposed between radio assembly 134 and multiplexer 182 and/or demultiplexer 186. As another example, power splitter 176 and/or power combiner 184 may be disposed between multiplexer 182 and/or demultiplexer 186 and first antenna 102 and/or second antenna 104. Other configurations are also contemplated.

It will be understood, and without being limited to any particular theory, that reflections on a transmission line may specified in terms of Voltage Standing Wave Ratio (VSWR). VSWR is a ratio of the maximum and minimum values of the standing wave on a transmission line. To improve VSWR, a resistive element (not illustrated) may be added between a parametrically determined position along a tip (e.g., first end 258 or second end 260 (FIG. 15)) of the longest forward antenna element (e.g., first one 140*a* of first antenna elements) and a cover frame (not illustrated) that makes contact with structure 108 (FIG. 1). This lowers the VSWR, by increasing the radiation resistance of the antenna. The resistive element may be rated for the power delivered by radio assembly 134 (e.g., first radio 160 or second radio 162) (FIG. 7).

Optionally, to further improve the impedance match and ensure maximum power is actually accepted by first antenna 102 and/or second antenna 104, a transformer (not illustrated) may be utilized in antenna system 100.

Figure 8:
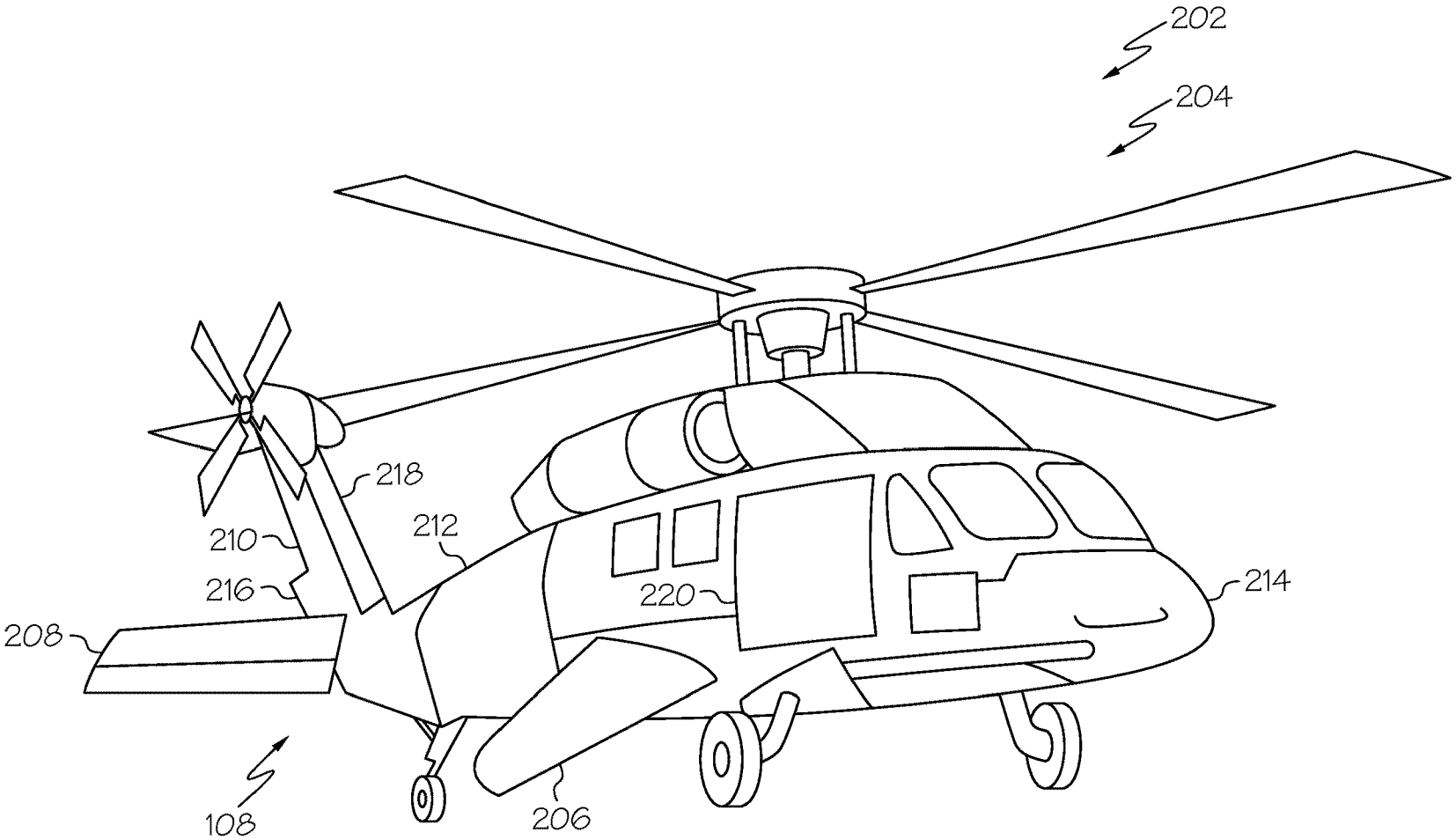
FIG. 8 is a schematic perspective view of one embodiment of a vehicle of FIG. 1.

Referring to FIG. 8, and with reference to FIG. 1, as one example, structure 108 may be a component or element of vehicle 202 (FIG. 1). As one example, and as illustrated in FIG. 8, vehicle 202 may be aerospace vehicle 204. As another example (not illustrated), vehicle 202 may be a land vehicle. As yet another example (not illustrated), vehicle 202 may be a marine vehicle. Structure 108 may also be any other fixed structure, assembly or the like that utilizes antenna system 100 (FIG. 1) to transmit and/or receive electromagnetic radiation 106 (FIG. 1). As non-limiting examples, structure 108 may include a tower (e.g., a radio tower), a pole (e.g., an antenna pole), a building or the like.

As one general, non-limiting example, and as illustrated in FIG. 8, aerospace vehicle 204 may be a rotary-wing aircraft (e.g., a helicopter or rotorcraft unmanned aerial vehicle) and structure 108 may be a structural component of the rotary-wing aircraft. As another general, non-limiting example (not illustrated), aerospace vehicle 204 may be a fixed-wing aircraft (e.g., an airplane or a fixed-wing unmanned aerial vehicle) and structure 108 may be a structural component of the fixed-wing aircraft. As another general, non-limiting example (not illustrated), aerospace vehicle 204 may be a missile.

As one general, non-limiting example, structure 108 may be a primary structure of vehicle 202 (e.g., aerospace vehicle 204). As used herein, the term "primary structure" generally refers to any structure that is essential for carrying loads (e.g., strains, stresses and/or forces) encountered during movement of vehicle 202 (e.g., during flight of aerospace vehicle 204). As another general, non-limiting example, structure 108 may be secondary structure of vehicle 202 (e.g., aerospace vehicle 204). As used herein, the term "secondary structure" generally refers to any structure that assists the primary structure in carrying loads encountered during movement of vehicle 202.

Referring still to FIG. 8, and with reference to FIG. 1, as one specific, non-limiting example, structure 108 may be horizontal wing 206 of aerospace vehicle 204. As another specific, non-limiting example, structure 108 may be horizontal stabilizer 208 of aerospace vehicle 204. As another specific, non-limiting example, structure 108 may be vertical stabilizer 210 of aerospace vehicle 204. As another specific, non-limiting example, structure 108 may be tail boom 212 of aerospace vehicle 204. As another specific, non-limiting example, structure 108 may be fuselage 214 of aerospace vehicle 204. As another specific, non-limiting example, structure 108 may be tail section 216 of aerospace vehicle 204. As another specific, non-limiting example, structure 108 may be fairing 218 of aerospace vehicle 204, for example, of horizontal wing 206, vertical stabilizer 210, horizontal stabilizer 210, tail boom 212 or tail section 216 of aerospace vehicle 204. As another specific, non-limiting example, structure 108 may be door 220 of aerospace vehicle 204. As another specific, non-limiting example, structure 108 may be any other empennage (not explicitly illustrated) of aerospace vehicle 204. As yet another specific, non-limiting example, structure 108 may be a selectively removable cover (not explicitly illustrated) of aerospace vehicle 204.

Referring to FIG. 1, and with reference to FIG. 8, as described herein above and in any of the examples provided herein, first antenna 102 (FIG. 1) may be disposed at first end 110 (FIG. 1) of structure 108 and second antenna 104 (FIG. 1) may be disposed at second end 112 (FIG. 1) of structure 108. With specific reference to the example of aerospace vehicle 204 (FIG. 8), first end 110 may be a leading edge or forward end of structure 108 (e.g., horizontal wing 206, vertical stabilizer 210, horizontal stabilizer 210, tail section 216 or door 220) and second end 112 may be a trailing edge of aft end of structure 108 (e.g., horizontal wing 206, vertical stabilizer 210, horizontal stabilizer 210, tail section 216 or door 220). As used herein, the terms "leading," "forward," "trailing," and "aft" are defined relative to the direction of travel of aerospace vehicle 204. Alternatively, first end 110 may be a starboard side of structure 108 (e.g., tail boom 212 or fuselage 214) and second end 112 may be a port side of structure 108 (e.g., tail boom 212 or fuselage 214).

Figure 9:
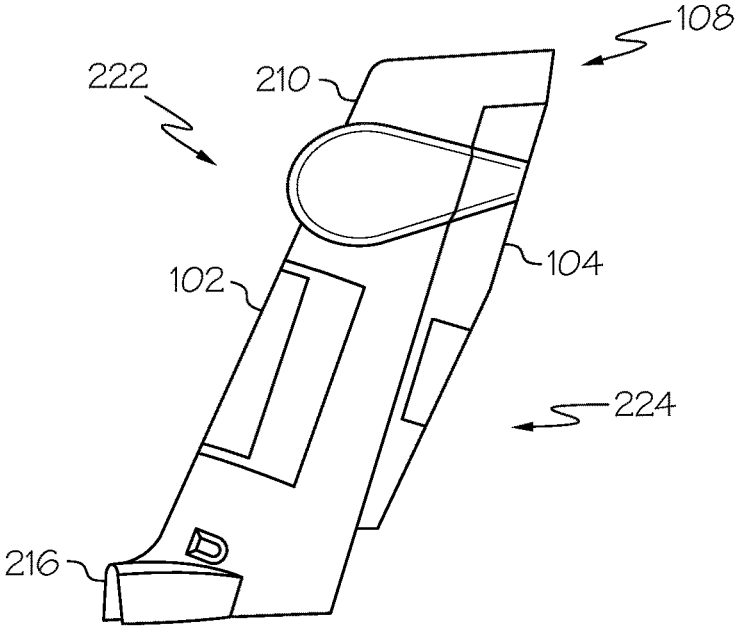
FIG. 9 is a schematic side elevational view of one embodiment of a structure of FIG. 1.

Referring to FIG. 9, as one specific, non-limiting example, structure 108 may be vertical stabilizer 210 of tail section 216 of aerospace vehicle 204 (FIG. 8). First antenna 102 may be coupled to forward end 222 of vertical stabilizer 210. Second antenna 104 may be coupled to aft end 224 of vertical stabilizer 210. First antenna 102 and second antenna 104 may be physically separated by vertical stabilizer 210. As one example, first antenna 102 may be mounted externally on vertical stabilizer 210 at forward end 222 and second antenna 104 may be mounted externally on vertical stabilizer 210 at aft end 224. First antenna 102 may be covered by a radome (not illustrated) mounted to vertical stabilizer 210 to protect first antenna 102. Second antenna 104 may be covered by another radome (not illustrated) mounted to vertical stabilizer 210 to protect second antenna 102. As another example, first antenna 102 may be mounted within vertical stabilizer 210 proximate (e.g., at or near) forward end 222 and second antenna 104 may be mounted within vertical stabilizer 210 proximate aft end 224. A portion of vertical stabilizer 210 at forward end 222 may act as a radome to protect first antenna 102. A portion of vertical stabilizer 210 at aft end 224 may act as another radome to protect second antenna 104. As yet another example, first antenna 102 may be built into (e.g., embedded within or integral to) the external paneling, also known as skin, of vertical stabilizer 210 and second antenna 104 may be built into the external paneling of vertical stabilizer 210.

Figure 10:
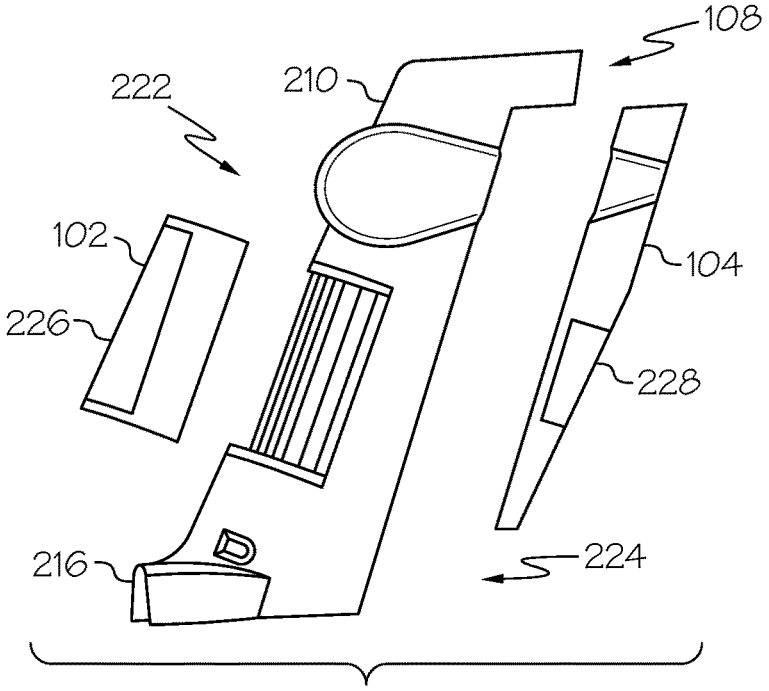
FIG. 10 is an exploded schematic side elevational view of one embodiment of the structure of FIG. 1, a first fairing and a second fairing.

Referring to FIG. 10, as another specific, non-limiting example, structure 108 may be vertical stabilizer 210. First antenna 102 may be coupled to first (e.g., forward) fairing 226. Second antenna 104 may be coupled to second (e.g., aft) fairing 228. First fairing 226 and second fairing 228 may be examples of fairing 218 (FIG. 8). First fairing 226 may be coupled to forward end 222 of vertical stabilizer 210, for example, along a leading edge. Second fairing 228 may be coupled to aft end 224 of vertical stabilizer 210, for example, along trailing edge 224. First fairing 226 and, thus, first antenna 102, and second fairing 228 and, thus, second antenna 104, may be physically separated by vertical stabilizer 210. As one example, first antenna 102 may be mounted to an interior surface of first fairing 226 and second antenna 104 may be mounted to an interior surface of second fairing 228. As another example, first antenna 102 may be built into (e.g., embedded within or integral to) first fairing 226 and second antenna 104 may be built into second fairing 228. First fairing 226 may acts as a radome to protect first antenna 102. Second fairing 228 may act as another radome to protect second antenna 104.

While FIG. 10 illustrates one example embodiment of first fairing 226 and second fairing 228 being coupled to vertical stabilizer 210 of tail section 216 of aerospace vehicle 204, in other example embodiments, first fairing 226 and second fairing 228 may be coupled to a forward end and an aft end, respectively, of other structures 108 of aerospace vehicle 204, for example, wing 206, horizontal stabilizer 208 (FIG. 8) and the like.

Figure 11:
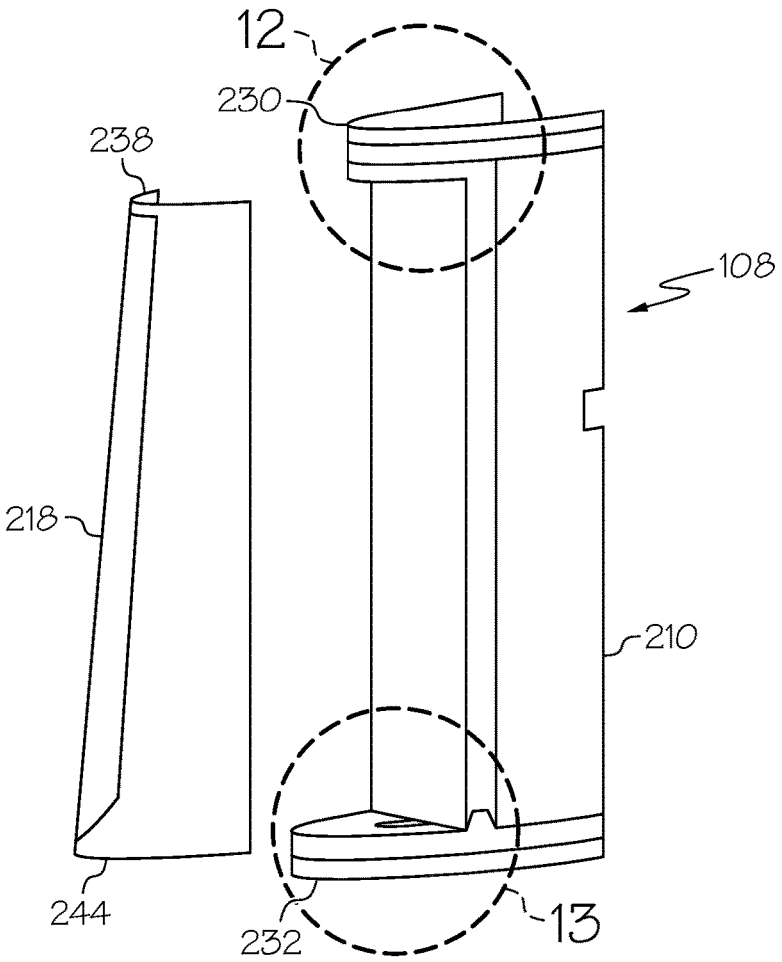
FIG. 11 is a partial schematic perspective view of one embodiment of the structure of FIG. 1 and a fairing.
Figure 12:
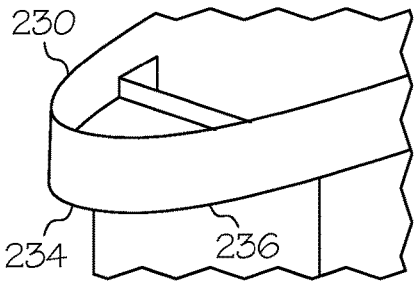
FIG. 12 is a schematic perspective view of one embodiment of a first fairing support of FIG. 11.
Figure 13:
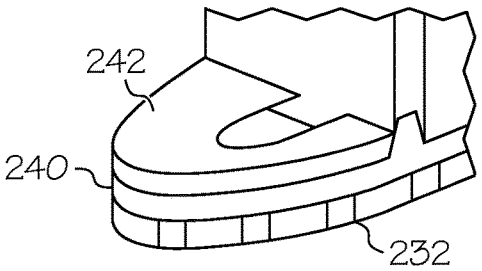
FIG. 13 is a schematic perspective view of one embodiment of a second fairing support of FIG. 11.

Referring to FIGS. 11-13, as one example, structure 108 (e.g., vertical stabilizer 210) may include first fairing support 230 and second fairing support 232. First fairing support 230 may be opposite second fairing support 232. Fairing 218 may be positioned between and coupled to first fairing support 230 and second fairing support 232. While not explicitly illustrated in FIG. 11, fairing 218 may include antenna (e.g., first antenna 102 or second antenna 104 (FIG. 1)) or antenna elements (e.g., first antenna elements 140 or second antenna elements 142 (FIG. 1)). Thus, as illustrated in FIG. 11, fairing 218 may be one example of first fairing 226 including first antenna 102 (FIG. 10) or second fairing 228 including second antenna 104 (FIG. 10).

It will be understood that FIG. 11 illustrates a portion of one end of structure 108 including two fairing supports (e.g., first fairing support 230 and second fairing support 232) and one fairing (e.g., fairing 218) and that structure 108 may include another two fairing supports and another one fairing at another end opposite the one end illustrated.

Referring to FIG. 12, as one example, first fairing support 230 may include first rib 234. First rib 234 may be one of a plurality of ribs defining the shape of structure 108 (e.g., vertical stabilizer). As one example, the plurality of ribs may be coupled to internal stringers, stiffeners, spars or the like in order to structurally support structure 108. First rib 234 may be a composite structure. As one example, first rib 234 may be a fiber-reinforced polymer ("FRP"). As another example, first rib 234 may be a GFRP. As another example, first rib 234 may be a CFRP. First fairing support 230 (e.g., first rib 234) may include first mounting surface 236. First mounting surface 236 may have a shape corresponding to the shape of first end 238 of fairing 218 (FIG. 11). First end 238 of fairing 218 may be seated within and coupled to first mounting surface 236. As one example, fairing 218 may be adhesively bonded to first fairing support 230. As one example, first end 238 of fairing 218 may be adhesively bonded to first mounting surface 236 of first rib 234. As another example, fairing 218 may be mechanically connected to first fairing support 230. First fairing support 230 may also provide electrical connection of antenna (e.g., first antenna 102 or second antenna 104). As one example, first mounting surface 236 may include a TNC connector (not explicitly illustrated).

Referring to FIG. 13, as one example, second fairing support 232 may include second rib 240. Second rib 240 may be another one of the plurality of ribs of structure 108. Second rib 240 may be a composite structure. As one example, second rib 240 may be a FRP. As another example, second rib 240 may be a GFRP. As another example, second rib 240 may be a CFRP. Second fairing support 232 (e.g., second rib 240) may include second mounting surface 242. Second mounting surface 242 may have a shape corresponding to the shape of second end 244 of fairing 218 (FIG. 11) opposite first end 238. Second end 244 of fairing 218 may be seated within and coupled to second mounting surface 242. As one example, fairing 218 may be adhesively bonded to second fairing support 232. As one example, second end 244 of fairing 218 may be adhesively bonded to second mounting surface 242 of second rib 240. As another example, fairing 218 may be mechanically connected to second fairing support 232. Second fairing support 232 may also provide electrical connection of antenna (e.g., first antenna 102 or second antenna 104). As one example, second mounting surface 242 may include a TNC connector (not explicitly illustrated).

Figure 14:
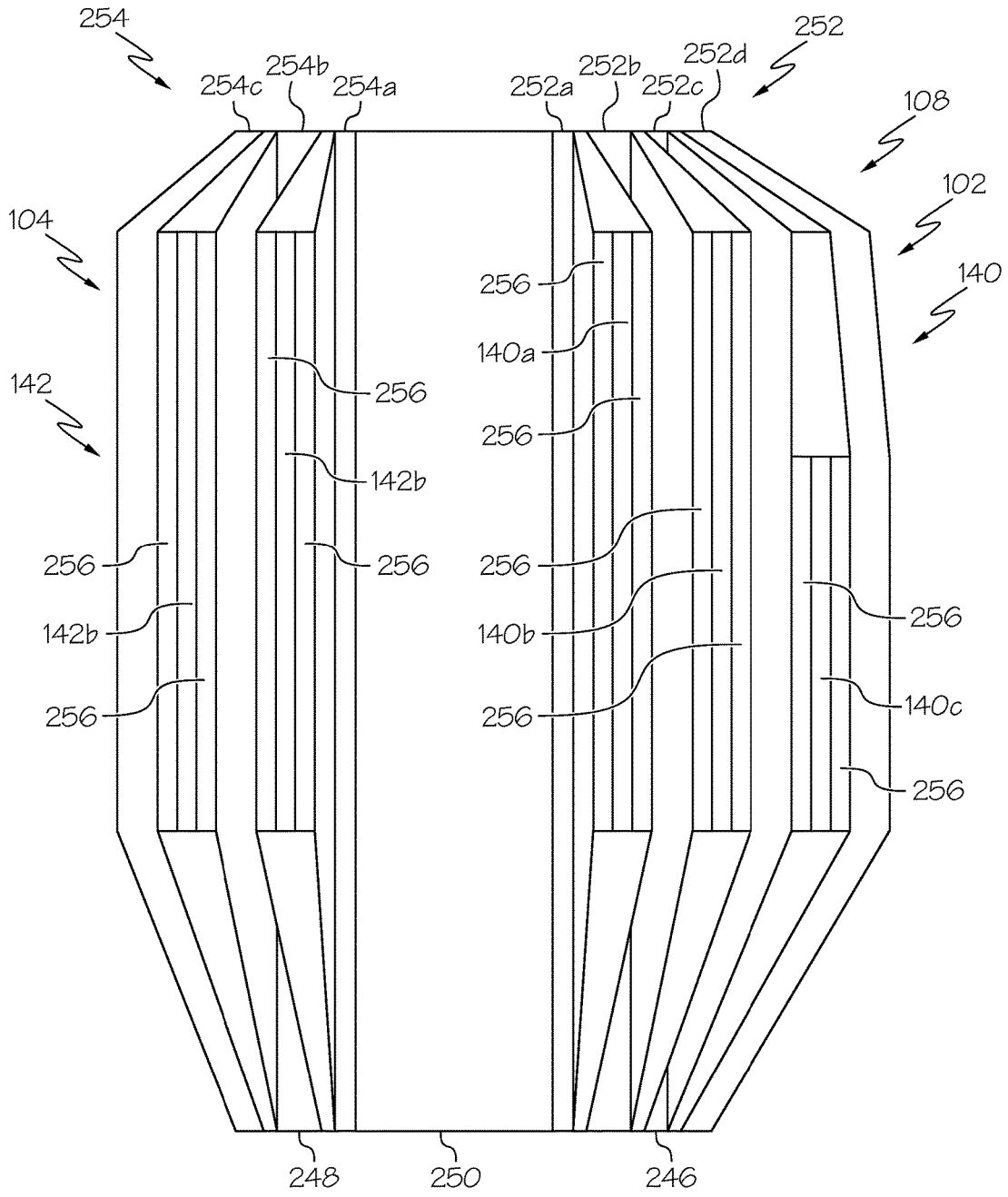
FIG. 14 is a schematic side elevational view of one embodiment of the structure of FIG. 1.

Referring to FIG. 14, as one example, structure 108 may include first antenna structure 246 and second antenna structure 248 opposite first antenna structure 246. Structure 108 may include intermediate structure 250. First antenna structure 246 may be coupled to intermediate structure 250 at first end 110 of structure 108. Second antenna structure 248 may be coupled to intermediate structure 250 at second end of structure 108. Intermediate structure 250 may physically separate first antenna structure 246 and second antenna structure 248.

As one example, first antenna structure 246 may include at least one first composite ply 252 and first antenna 102. First antenna 102 may be coupled to first composite ply 252. As one example, second antenna structure 248 may include at least one second composite ply 254 and second antenna 104. Second antenna 104 may be coupled to second composite ply 254.

As another example, and as illustrated in FIG. 14, first antenna structure 246 may include a plurality of first composite plies 252 and a plurality of first antenna elements 140. First composite plies 252 and first antenna elements 140 may be stacked to form a first sandwich structure (e.g., a first laminate). Second antenna structure 248 may include a plurality of second composite plies 254 and a plurality of second antenna elements 142. Second composite plies 254 and second antenna elements 142 may be stacked to form a second sandwich structure (e.g., a second laminate).

First antenna structure 246 may have various configurations depending, for example, on the number of first antenna elements 140, the number of operating frequencies (e.g., first frequency band 136, second frequency band 138, third frequency band 148, etc.) and the like. Similarly, second antenna structure 248 may have various configurations depending, for example, on the number of second antenna elements 142, the number of operating frequencies and the like.

As one general, non-limiting example, the configuration of the sandwich structure of first antenna structure 246 and/or second antenna structure 248 may include composite ply—antenna element—composite ply—antenna element, etc. As one example, an innermost composite ply may define an inner mold line of the sandwich structure and the outermost antenna element may define an outer mold line of the sandwich structure (e.g., the configuration of the sandwich structure may terminate with an antenna element). In such a configuration, the outermost antenna element may be covered by a protective layer (e.g., an electromagnetically transparent film). As another example, an innermost composite ply may define the inner mold line of the sandwich structure and an outermost composite ply may define the outer mold line of the sandwich structure (e.g., the configuration of the sandwich structure may terminate with a composite ply). As such, the composite plies of the sandwich structure may act as a radome protecting each antenna element.

As one specific, non-limiting example, and as illustrated in FIG. 14, the configuration first antenna structure 246 (e.g., of the first sandwich structure) may include first one 252*a* of first composite plies 252—first one 140*a* of first antenna elements 140—second one 252*b* of first composite plies 252—second one 140*b* of first antenna elements 140—third one 252*c* of first composite plies 252—third one 140*c* of first antenna elements 140—fourth one 252*d* of first composite plies 252. The configuration second antenna structure 248 (e.g., of the second sandwich structure) may include first one 254*a* of second composite plies 254—first one 142*a* of second antenna elements 142—second one 254*b* of second composite plies 254—second one 142*b* of second antenna elements 142—third one 254*c* of second composite plies 254. As described above and with reference to FIG. 3, such a configuration of first antenna structure 246 may provide multi-band radiation of first antenna 102 (e.g., at first frequency band 136 and second frequency band 138) and such a configuration of second antenna structure 248 may provide single band radiation of second antenna 104 (e.g., at first frequency band 136).

In accordance with the examples described herein, for example, as illustrated in FIGS. 3-6, other configurations of first antenna structure 246 (e.g., the number of first composite plies 252 and the number of first antenna elements 140) and/or second antenna structure 248 (e.g., the number of second composite plies 254 and the number of second antenna elements 142) are also contemplated, for example, to provide different combinations of single band radiation and/or multi-band radiation.

Referring to FIG. 14, and with reference to FIGS. 3-6, first composite plies 252 and/or second composite plies 254 may be examples of dielectric material 150 (FIGS. 3-6). As one general, non-limiting example, first composite plies 252 and/or second composite plies 254 may be fiber-reinforced polymer plies. As one general, non-limiting example, first composite plies 252 and/or second composite plies 254 may include a sheet or mat of reinforcing fibrous material bonded together by a polymer matrix material. The polymer matrix material may include any suitable thermoset resin (e.g., epoxy) or thermoplastic. The fibrous material may include any suitable woven or nonwoven (e.g., knit, braided or stitched) continuous reinforcing fibers or filaments. Each one of first composite plies 252 and/or each one of second composite plies 254 may include the same constituent materials (e.g., reinforcing fibrous material and/or polymer matrix material) or may include different constituent materials.

As one specific, non-limiting example, first composite plies 252 and/or second composite plies 254 may be GFRP plies. As another specific, non-limiting example, first composite plies 252 and/or second composite plies 254 may be fiberglass fiber-reinforced polymer plies. As another specific, non-limiting example, first composite plies 252 and/or second composite plies 254 may be quartz fiber-reinforced polymer plies.

As one example, first composite plies 252 and/or second composite plies 254 may include a sheet of the reinforcing fibrous material pre-impregnated with the polymer matrix material (e.g., a pre-preg), also known as a dry lay up. As another example, first composite plies 252 and/or second composite plies 254 may include a sheet of the reinforcing fibrous material and the polymer matrix material is applied to the reinforcing fibrous material, also known as a wet lay up.

First antenna elements 140 may be embedded between first composite plies 252. Second antenna elements 142 may be embedded between second composite plies 254. As one example, first composite plies 252 and first antenna elements 140 (e.g., stake monopole antennas) may be consecutively laid up, for example, within a mold (not illustrated) and co-cured to form first antenna structure 246. Each one of first antenna elements 140 may be secondarily bonded (e.g., adhesively bonded) to an adjacent pair of first composite plies 252 (e.g., each one of composite plies 252 on either side of the one of first antenna elements 140). As one example, film adhesive 256 may be applied between each one of first antenna elements 140 and each one of first composite plies 252, as illustrated in FIG. 14. Similarly, second composite plies 254 and second antenna elements 142 (e.g., stake monopole antennas) may be consecutively laid up, for example, within a mold and co-cured to form second antenna structure 248. Each one of second antenna elements 142 may be secondarily bonded (e.g., adhesively bonded) to an adjacent pair of second composite plies 254 (e.g., each one of second composite plies 254 on either side of the one of second antenna elements 142). As one example, film adhesive 256 may be applied between each one of second antenna elements 142 and each one of second composite plies 254, as illustrated in FIG. 14. Film adhesive 256 may be one example of dielectric material 150 (FIGS. 3-6).

As another example, first composite plies 252 may be consecutively laid up and co-cured. Gaps or open spaces (not illustrated) may be formed between adjacent ones of first composite plies 252. Each one of the gaps may be suitably sized to receive an associated one of first antenna elements 140. Each one of first antenna elements 140 may be fit within an associated one of the gaps between the adjacent ones of first composite plies 252. Each one of the first antenna elements 140 may be adhesively bonded (e.g., with film adhesive 256) to the adjacent ones of first composite plies 252. Similarly, second composite plies 254 may be consecutively laid up and co-cured. Gaps or open spaces (not illustrated) may be formed between adjacent ones of second composite plies 254. Each one of the gaps may be suitably sized to receive an associated one of second antenna elements 142. Each one of second antenna elements 142 may be fit within an associated one of the gaps between the adjacent ones of second composite plies 254. Each one of the second antenna elements 142 may be adhesively bonded (e.g., with film adhesive 256) to the adjacent ones of second composite plies 254.

Each of first composite plies 252 and/or second composite plies 254 may include structural and transmissive characteristics and/or properties. The structural and transmissive characteristics of the selected reinforcing fibrous material may include, but are not limited to, tensile strength, electrical conductivity and/or dielectric constant. The structural and transmissive characteristics of first composite plies 252 and/or second composite plies 254 may be dictated by, for example, the tensile strength, electrical conductivity and/or dielectric constant of the reinforcing fibrous material and/or the polymer matrix material and may be considered in determining the suitability of first composite plies 252 and/or second composite plies 254 for use in first antenna structure 246 and second antenna structure 248, respectively.

As one example, at least a portion of first composite plies 252, for example, a portion directly in front of and/or behind first antenna elements 140 may be transparent to electromagnetic radiation 106 (FIG. 1) emitted from first antenna elements 140. Similarly, at least a portion of second composite plies 254, for example, a portion directly in front of and/or behind second antenna elements 142 may be transparent to electromagnetic radiation 106 emitted from second antenna elements 142. As one general, non-limiting example, first composite plies 252 and/or second composite plies 254 may be configured to not interfere with electromagnetic radiation 106 (e.g., radio waves) transmitted and/or received by first antenna 102 and/or second antenna 104, respectively. As one specific, non-limiting example, first composite plies 252 and/or second composite plies 254 may be transparent to electromagnetic radiation 106 having frequencies from approximately 3 kHz to approximately 400 GHz.

As another example, at least a portion of first composite plies 252, for example, a portion directly in front of and/or behind first antenna elements 140 may be transparent only to electromagnetic radiation 106 (FIG. 1) at select frequencies (e.g., at select wavelengths) emitted from first antenna elements 140. Similarly, at least a portion of second composite plies 254, for example, a portion directly in front of and/or behind second antenna elements 142 may be transparent to electromagnetic radiation 106 at select frequencies (e.g., at select wavelengths) emitted from second antenna elements 142.

First antenna structure 246 and/or second antenna structure 248 may include additional materials other than composite plies (e.g., first composite plies 252 and/or second composite plies 254).

As one example, first antenna structure 246 may include one or more core layers (not illustrated) disposed between one or more first composite plies 252 and first antenna elements 140. Similarly, second antenna structure 248 may include one or more core layers disposed between one or more second composite plies 254 and second antenna elements 142. The core layer may be another example of dielectric material 150 (FIG. 3). The core layer may provide additional structural rigidity and/or ballistic properties to first antenna structure 246 and/or second antenna structure 248. As one example, each core layer may include a honeycomb structure. As another example, each core layer may include a foam material (e.g., an open cell foam, a closed cell foam, a syntactic foam, a structural foam and the like).

Like the composite plies (e.g., first composite plies 252 and/or second composite plies 254), at least a portion of the core layer, for example, a portion directly in front of and/or behind first antenna elements 140 and/or second antenna elements 142 may be transparent to electromagnetic radiation 106 (FIG. 1) emitted from first antenna elements 140 and/or second antenna elements 142, respectively.

As another example, one or more the core layers may include a plurality of reinforcing pins (not illustrated) to form a pin-reinforced core layer. The reinforcing pins may be conductive or non-conductive. As one example, the reinforcing pins may be made of carbon. As another example, the reinforcing pins may be made of glass. As yet another example, the reinforcing pins may be made of fiberglass. As one example, the reinforcing pins may be made of quartz. The reinforcing pins may extend partially or completely through a thickness of the core layer.

Referring to FIG. 14, and with reference to the example embodiment illustrated in FIGS. 10 and 11, first fairing 226 (FIG. 10) may be one example of first antenna structure 246. Second fairing 228 (FIG. 10) may be one example of second antenna structure 248. Vertical stabilizer 210 may be one example of intermediate structure 250.

Figure 15:
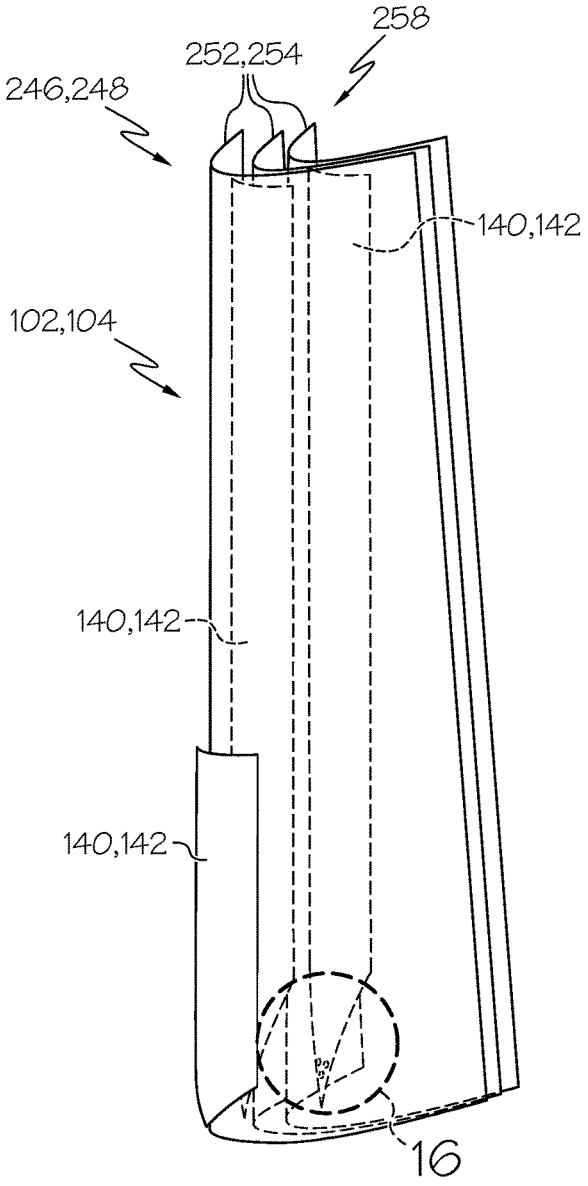
FIG. 15 is a schematic perspective view of one embodiment of an antenna structure of FIG. 14.

Referring to FIG. 15, and with reference to FIGS. 10 and 14, as one example, first antenna structure 246 and/or second antenna structure 248 may provide conformal antennas. As one example, first antenna 102 and/or second antenna 104 may be a conformal antenna. As another example, each one of first antenna elements 140 and/or each one of second antenna elements 142 may conform to the shape of first antenna structure 246 and second antenna structure 248 (e.g., first composite plies 252 and second composite plies 254), respectively. As one example, first antenna structure 246 may define the shape of first end 110 of structure 108 (FIG. 1), for example, the leading edge of vertical stabilizer 210 (FIG. 10). Second antenna structure 248 may define second end 112 of structure 108, for example, the trailing edge of vertical stabilizer 210.

Figure 16:
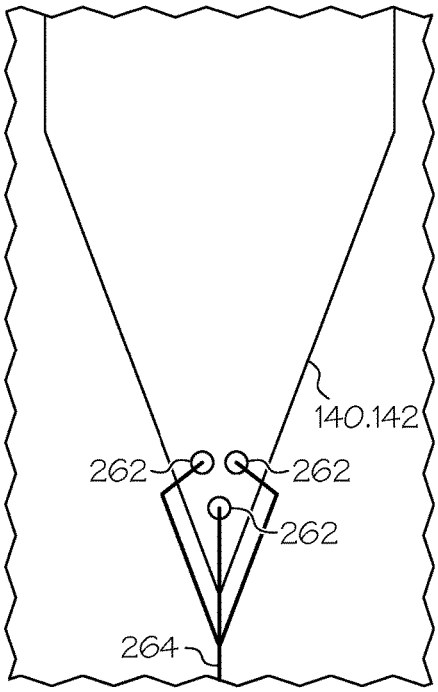
FIG. 16 is a schematic front elevational view of one embodiment of an end of an antenna element of FIG. 15.

Referring to FIG. 16, and with reference to FIG. 15, at least one of first antenna elements 140 (FIG. 15) and at least one of second antenna elements 142 (FIG. 15) may include through holes 262. Through holes 262 may provide for connection of electrical leads 264. As one example, electrical leads 264 may be soldered to each one of first antenna elements 140 and at least one of second antenna elements 142. Feed line 158 (e.g., first feed line 128 and/or second feed line 130) (FIG. 1) may be coupled to electrical leads 264, for example, by an RF connector, such as the TNC connector. As one example, through holes 262 and electrical leads 264 may be located proximate (e.g., at or near) first end 258 (FIG. 16) of each one of first antenna elements 140 and each one of second antenna elements 142. As one example, through holes 262 and electrical leads 264 may be located proximate second end 260 (FIG. 16) of each one of first antenna elements 140 and each one of second antenna elements 142. Those skilled in the art will recognize that the connection location of feed line 158 and first antenna elements 140 and/or second antenna elements 142 may depend, for example, on the particular application and/or type of antenna (e.g., antenna element).

Referring to FIGS. 15 and 16, first end 258 and/or second end 260 of each one of first antenna elements 140 and/or second antenna elements 142 may include a particular shape depending, for example, on the type of feed. As one example, first end 258 and/or second end 260 may be flat, for example, first end 258 may be flat as illustrated in FIG. 15. As another example, first end 258 and/or second end 260 may be pointed (e.g., terminate at a point), for example, second end 260 may be pointed, as illustrated in FIGS. 15 and 16.

Referring to FIG. 17, and with reference to FIGS. 1-16, one embodiment of method, generally designated 300, for providing omnidirectional coverage of antenna system 100 is disclosed. Modifications, additions, or omissions may be made to method 300 without departing from the scope of the present disclosure. Method 300 may include more, fewer, or other steps. Additionally, steps may be performed in any suitable order.

Referring to FIG. 17, and with reference to FIGS. 1 and 2, method 300 may include providing structure 108, as shown at block 302. Structure 108 may include first end 110 and second end 112 opposite the first end 110.

Referring to FIG. 17, and with reference to FIGS. 1 and 2, method 300 may include providing first antenna 102, as shown at block 304. Method 300 may include coupling first antenna 102 to first end 110 of structure 108, as shown at block 306. First antenna 102 may include first radiation pattern 114. First radiation pattern 114 may include first null 118. Structure 108 may create first null 118.

Referring to FIG. 17, and with reference to FIGS. 1 and 2, method 300 may include providing second antenna 104 opposite first antenna 102, as shown at block 308. Method 300 may include coupling second antenna 104 to the second end 112 of structure 108, as shown at block 310. Second antenna 104 may include second radiation pattern 116. Second radiation pattern may include second null 120. Structure 108 may create second null 120.

First antenna 102 and second antenna 104 may each configured to operate within first frequency band 136. At least one of first antenna 102 and second antenna 104 may further be configured to operate within second frequency band 138. Second frequency band 138 and first frequency band 136 may be different.

Referring to FIG. 17, and with reference to FIG. 2, method 300 may include filling first null 118 with second radiation pattern 116, as shown at block 312. Method may include filling second null 120 with first radiation pattern 114, as shown at block 314.

Referring to FIG. 17, and with reference to FIGS. 1 and 7, method 300 may include phasing first antenna 102 and second antenna 104 to prevent destructive interference from interaction of first radiation pattern 114 and second radiation pattern 116, as shown at block 316.

Examples of the present disclosure may be described in the context of aerospace vehicle manufacturing and service method 1100 as shown in FIG. 18 and aerospace vehicle 1200 as shown in FIG. 19. Aerospace vehicle 1200 may be one example of vehicle 202 illustrated in FIG. 1 or aerospace vehicle 204 (e.g., an aircraft) illustrated in FIG. 8. As one example, aerospace vehicle 1200 may be a fixed-wing aircraft. As another example, aerospace vehicle 1200 may be a rotary-wing aircraft.

During pre-production, the illustrative method 1100 may include specification and design, as shown at block 1102, of aerospace vehicle 1200 and material procurement, as shown at block 1104. During production, component and subassembly manufacturing, as shown at block 1106, and system integration, as shown at block 1108, of aerospace vehicle 1200 may take place. Thereafter, aerospace vehicle 1200 may go through certification and delivery, as shown block 1110, to be placed in service, as shown at block 1112. While in service, aerospace vehicle 1200 may be scheduled for routine maintenance and service, as shown at block 1114. Routine maintenance and service may include modification, reconfiguration, refurbishment, etc. of one or more systems of aerospace vehicle 1200.

Each of the processes of illustrative method 1100 may be performed or carried out by a system integrator, a third party, and/or an operator (e.g., a customer). For the purposes of this description, a system integrator may include, without limitation, any number of aircraft manufacturers and major-system subcontractors; a third party may include, without limitation, any number of vendors, subcontractors, and suppliers; and an operator may be an airline, leasing company, military entity, service organization, and so on.

As shown in FIG. 19, aerospace vehicle 1200 produced by illustrative method 1100 may include airframe 1202 with a plurality of high-level systems 1204 and interior 1206. Examples of high-level systems 1204 include one or more of propulsion system 1208, electrical system 1210, hydraulic system 1212 and environmental system 1214. Any number of other systems may be included. Although an aerospace example is shown, the principles disclosed herein may be applied to other industries, such as the automotive industry, the marine industry, the telecommunications industry or the like.

The apparatus and methods shown or described herein may be employed during any one or more of the stages of the manufacturing and service method 1100. For example, components or subassemblies corresponding to component and subassembly manufacturing (block 1106) may be fabricated or manufactured in a manner similar to components or subassemblies produced while aerospace vehicle 1200 is in service (block 1112). Also, one or more examples of the apparatus, systems and methods, or combination thereof may be utilized during production stages (blocks 1108 and 1110), for example, by providing omnidirectional coverage of radio waves in aerospace vehicles. Similarly, one or more examples of the apparatus and methods, or a combination thereof, may be utilized, for example and without limitation, while aerospace vehicle 1200 is in service (block 1112) and during maintenance and service stage (block 1114).

Although various embodiments of the disclosed apparatus, systems and methods have been shown and described, modifications may occur to those skilled in the art upon reading the specification. The present application includes such modifications and is limited only by the scope of the claims.

What is claimed is:

1. An antenna system comprising:

a first antenna structure comprising:

a plurality of first antenna elements configured to emit first electromagnetic waves; and a plurality of first dielectric layers transparent to the first electromagnetic waves, wherein each one of the first antenna elements is disposed between and surrounded by an associated pair of the first dielectric layers so that the first dielectric layers and the first antenna elements alternate in a first stacked configuration;

a second antenna structure, opposite the first antenna structure, comprising:

a plurality of second antenna elements configured to emit second electromagnetic waves; and a plurality of second dielectric layers transparent to the second electromagnetic waves, wherein each one of the second antenna elements is disposed between and surrounded by an associated pair of the second dielectric layers so that the second dielectric layers and the second antenna elements alternate in a second stacked configuration;

a first feed line coupled to the first antenna elements and a transmitter, the first feed line having a first length selected to position the first electromagnetic waves at a first phase based on a first velocity of a signal passing through the first feed line and a first time interval for the signal to be communicated from the transmitter to the first antenna elements; and a second feed line coupled to the second antenna elements and the transmitter, the second feed line having a second length, different than the first length, selected to position the second electromagnetic waves at a second phase, different than the first phase, based on a second velocity of the signal passing through the second feed line and a second time interval for the signal to be communicated from the transmitter to the second antenna elements, wherein a length difference between the first length and the second length produces a phase difference between the first phase and the second phase that produces an omnidirectional radiation pattern of the first electromagnetic waves and the second first electromagnetic waves.

2. The system of claim 1 wherein:

the first antenna structure radiates the first electromagnetic waves in a first radiation pattern and the second antenna structure radiates the second electromagnetic waves in a second radiation pattern;

the first radiation pattern comprises a first null and the second radiation pattern comprises a second null, opposite the first null;

the first radiation pattern fills the second null and the second radiation pattern fills the first null; and the phase difference is selected to prevent destructive interference from interaction of the first radiation pattern and the second radiation pattern.

3. The system of claim 1 wherein the first antenna elements and the second antenna elements are each configured to operate within a first frequency band.

4. The system of claim 1 wherein:

at least one of the first antenna elements is configured to operate within a first frequency band;

at least one of the second antenna elements s configured to operate within the first frequency band;

at least one of the second antenna elements is configured to operate within a second frequency band; and the second frequency band and the first frequency band are different.

5. The system of claim 1 wherein:

at least two of the first antenna elements each comprises a first length configured to operate within a first frequency band;

at least two of the second antenna elements each comprises the first length configured to operate within the first frequency band;

at least one of the second antenna elements comprises a second length configured to operate within a second frequency band; and the second frequency band and the first frequency band are different.

6. The system of claim 5 wherein:

the first antenna structure and the second antenna structure are coupled to and are separated by an intermediate support structure;

the at least one of the second antenna elements comprising the second length is located farthest from the structure; and the second frequency band is higher than the first frequency band.

7. The system of claim 5 wherein at least one of the first antenna elements or at least one of the second antenna elements comprises a third length configured to operate within a third frequency band, and wherein the third frequency band is different than the first frequency band and the second frequency band.

8. The system of claim 1 wherein:

each one of the first dielectric layers and the second dielectric layers comprises a fiber reinforced polymer composite;

the first antenna elements and the first dielectric layers are co-cured to from the first antenna structure; and the second antenna elements and the second dielectric layers are co-cured to from the first antenna structure.

9. The system of claim 1 wherein:

each one of the first antenna elements is bonded to at least one of the associated pair of the first dielectric layers by a film adhesive; and each one of the second antenna elements is bonded to at least one of the associated pair of the second dielectric layers by the film adhesive.

10. An antenna system comprising:

a structure comprising a first end and a second end opposite the first end;

a first antenna laminate structure coupled to the first end of the structure, the first antenna laminate structure comprising:

a plurality of first monopole antenna elements configured to emit first electromagnetic waves; and a plurality of first composite plies transparent to the first electromagnetic waves, wherein each one of the first monopole antenna elements is sandwiched between and surrounded by an associated pair of the first composite plies so that the first composite plies and the first monopole antenna elements alternate in a first stacked configuration; and a second antenna laminate structure coupled to the second end of the structure, the second antenna laminate structure comprising:

a plurality of second monopole antenna elements configured to emit second electromagnetic waves; and a plurality of second composite plies transparent to the second electromagnetic waves, wherein each one of the second monopole antenna elements is sandwiched between and surrounded by an associated pair of the second composite plies so that the second composite plies and the second monopole antenna elements alternate in a second stacked configuration; and wherein:

at least one of the first antenna elements is configured to operate within a first frequency band;

at least one of the second antenna elements is configured to operate within the first frequency band; and the first electromagnetic waves have a first phase;

the second electromagnetic waves have a second phase that is different than the first phase;

the first antenna laminate structure and the second antenna laminate structure are configured to provide omnidirectional coverage in the first frequency band.

11. The system of claim 10 wherein:

the first antenna laminate structure radiates the first electromagnetic waves in a first radiation pattern and the second antenna laminate structure radiates the second electromagnetic waves in a second radiation pattern;

the structure creates a first null in the first radiation pattern and a second null in the second radiation pattern;

the first radiation pattern fills the second null and the second radiation pattern fills the first null; and a phase difference between the first phase and the second phase is selected to prevent destructive interference from interaction of the first radiation pattern and the second radiation pattern.

12. The system of claim 11 wherein:

at least two of the first monopole antenna elements each comprises a first length configured to operate within the first frequency band;

at least two of the second antenna elements each comprises the first length configured to operate within the first frequency band;

at least one of the second monopole antenna elements comprises a second length configured to operate within a second frequency band; and the second frequency band and the first frequency band are different.

13. The system of claim 10 wherein the first antenna laminate structure is a first fairing disposed at a leading edge of an aerospace vehicle, and wherein the second antenna laminate structure is a second fairing disposed at a trailing edge of an aerospace vehicle.

14. The system of claim 12 wherein at least one of the first antenna elements or at least one of the second antenna elements comprises a third length configured to operate within a third frequency band, and wherein the third frequency band is different than the first frequency band and the second frequency band.

15. The system of claim 10 further comprising:

a radio assembly;

a first feed line coupled to the radio assembly and the first monopole antenna elements, the first feed line having a first length selected to position the first electromagnetic waves at the first phase based on a first velocity of a signal passing through the first feed line and a first time interval for the signal to be communicated from the transmitter to the first monopole antenna elements; and a second feed line coupled to the radio assembly and the second monopole antenna elements, the second feed line having a second length, different than the first length, selected to position the second electromagnetic waves at the second phase based on a second velocity of the signal passing through the second feed line and a second time interval for the signal to be communicated from the transmitter to the second monopole antenna elements; and wherein a length difference between the first length and the second length produces a phase difference between the first phase and the second phase that produces the omnidirectional radiation pattern of the first electromagnetic waves and the second first electromagnetic waves in the first frequency band.

16. The system of claim 10 wherein each one of the first composite plies and the second composite plies comprises a fiber reinforced polymer composite having a dielectric constant less than six.

17. A method for providing omnidirectional coverage of an antenna system, the method comprising:

coupling a first antenna laminate structure to a first end of a structure, the first antenna laminate structure comprising:

a plurality of first antenna elements configured to emit first electromagnetic waves; and a plurality of first dielectric layers transparent to the first electromagnetic waves, wherein each one of the first antenna elements sandwiched between and surrounded by an associated pair of the first dielectric layers so that the first dielectric layers and the first antenna elements alternate in a first stacked configuration;

coupling a second antenna laminate structure to a second end of the structure, opposite the first end, the second antenna laminate structure comprising:

a plurality of second antenna elements configured to emit second electromagnetic waves; and a plurality of second dielectric layers transparent to the second electromagnetic waves, wherein each one of the second antenna elements is sandwiched between and surrounded by an associated pair of the second dielectric layers so that the second dielectric layers and the second antenna elements alternate in a second stacked configuration;

generating a first radiation pattern of the first electromagnetic waves with at least two of the first antenna elements in a first frequency band, the first radiation pattern comprising a first null created by the structure;

generating a second radiation pattern of the second electromagnetic waves with at least two of the second antenna elements in the first frequency band, the second radiation pattern comprising a second null created by the structure;

filling the first null with the second radiation pattern and filling the second null with the first radiation pattern;

producing an omnidirectional radiation pattern in the first frequency band with the first radiation pattern and the second radiation pattern; and producing a phase difference between a first phase of the first electromagnetic waves and a second phase of the second electromagnetic waves to prevent destructive interference from interaction of the first radiation pattern and the second radiation pattern in the first frequency band.

18. The method of claim 17 further comprising:

selecting a first length of a first feed line coupled to the first antenna elements to position the first electromagnetic waves at the first phase based on a first velocity of a signal passing through the first feed line and a first time interval for the signal to be communicated from a transmitter to the first antenna elements; and selecting a second length, different than the first length, of a second feed line coupled to the second antenna elements to position the second electromagnetic waves at the second phase, different than the first phase, based on a second velocity of the signal passing through the second feed line and a second time interval for the signal to be communicated from the transmitter to the second antenna elements, wherein a length difference between the first length and the second lengthproduces a phase difference between the first phase and the second phase that produces the omnidirectional radiation pattern of the first electromagnetic waves and the second irst electromagnetic waves in the first frequency band.

19. The method of claim 17 further comprising generating a third radiation pattern of third electromagnetic waves with at least one of the first antenna elements or at least one of the second antenna elements in a second frequency band, wherein the second frequency band is different than the first frequency band.

20. The method of claim 19 further comprising producing a unidirectional radiation pattern in the second frequency band with the third radiation pattern.

* * * * *